United States Patent [19]

DeRoche et al.

[11] Patent Number: 4,615,266

[45] Date of Patent: Oct. 7, 1986

[54] PRINTING APPARATUS EMPLOYING DEFORMABLE TRANSFER PAD

[75] Inventors: William M. DeRoche; David A. Kearney, both of Keene; Franklin L. Sibley, Swanzey Center, all of N.H.

[73] Assignee: Markem Corporation, Keene, N.H.

[21] Appl. No.: 661,437

[22] Filed: Oct. 16, 1984

[51] Int. Cl.[4] ..... B41F 17/00

[52] U.S. Cl. ..... 101/163; 101/150; 101/301; 101/334

[58] Field of Search ..... 101/163, 150, 170, 41, 101/44, 333, 334, 298, 301, 305, 320, 321

[56] References Cited

U.S. PATENT DOCUMENTS

| | | | |
|---|---|---|---|
| 1,524,326 | 1/1925 | Waite . | |
| 1,655,000 | 1/1928 | Waite . | |
| 1,688,470 | 10/1928 | O'Hara | 101/41 |
| 1,696,280 | 12/1928 | O'Hara | 101/41 |
| 1,696,281 | 12/1928 | O'Hara | 101/41 |
| 1,697,926 | 1/1929 | O'Hara | 101/334 X |
| 1,818,441 | 8/1931 | Waite . | |
| 1,833,767 | 11/1931 | Woodbury | 101/163 |
| 1,878,564 | 9/1932 | Woodbury | 101/163 |
| 1,878,565 | 9/1932 | Woodbury | 101/170 X |
| 2,235,820 | 3/1941 | Humphries . | |
| 2,238,985 | 4/1941 | Rosenthal . | |
| 2,314,828 | 3/1943 | Humphries . | |
| 2,842,046 | 7/1958 | Murray . | |
| 3,115,826 | 12/1963 | Reinhardt et al. | 101/334 X |
| 3,756,146 | 9/1973 | Norwood . | |
| 4,060,031 | 11/1977 | Philipp | 101/163 |
| 4,222,328 | 9/1980 | Doyle . | |
| 4,254,709 | 3/1981 | Arnolds . | |
| 4,314,504 | 2/1982 | Combeau . | |
| 4,365,554 | 12/1982 | Siegal et al. . | |
| 4,419,931 | 12/1983 | Seigal . | |

FOREIGN PATENT DOCUMENTS

| | | | |
|---|---|---|---|
| 1085892 | 7/1960 | Fed. Rep. of Germany . | |
| 2205430 | 8/1972 | Fed. Rep. of Germany . | |
| 2334179 | 1/1975 | Fed. Rep. of Germany . | |
| 169359 | 10/1982 | Japan | 101/44 |
| 748412 | 5/1956 | United Kingdom . | |
| 837481 | 6/1960 | United Kingdom . | |
| 881945 | 11/1961 | United Kingdom . | |
| 907109 | 10/1962 | United Kingdom . | |
| 911534 | 11/1962 | United Kingdom . | |
| 1432355 | 4/1976 | United Kingdom . | |
| 814791 | 3/1981 | U.S.S.R. | 101/321 |

OTHER PUBLICATIONS

Teca-Print AG catalogue, 1983.
Tampo Print GmbH catalogue, 1983.
Tampo Flex GmbH catalogue, 1983.
Dependable Machine Co. catalogue, Dec. 19, 1983.

*Primary Examiner*—Clifford D. Crowder
*Attorney, Agent, or Firm*—Robbins & Laramie

[57] ABSTRACT

A pad transfer printing machine is disclosed in which the engraved printing plate is suspended face-down at an elevated position above the surface to be printed, and is horizontally movable between a retracted position and a pad contacting position. The plate is inked and scraped as it moves horizontally and, at the pad contacting position, presents an inked image to a deformable transfer pad. A movable printing member drives the transfer pad in alternating upward and downward strokes and inverts the pad during each upward and downward stroke, so that the transfer pad is alternately brought into contact with the printing plate at the top of its stroke and with the surface to be printed at the bottom of its stroke. The elevated position of the printing plate renders it easily accessable for removal and replacement. Excess ink is automatically removed from the printing plate by the scraping device as the plate is removed, and the excess ink is returned to the ink supply.

10 Claims, 29 Drawing Figures

PRINTING APPARATUS EMPLOYING DEFORMABLE TRANSFER PAD

BACKGROUND OF THE INVENTION

1. Field of the Invention

The invention relates generally to printing apparatus, and is particularly concerned with an offset printing apparatus employing an engraved printing plate and a deformable transfer pad made of silicone rubber or the like.

2. Description of the Prior Art

Pad transfer printing is a useful technique for printing on various types of surfaces, particularly raised surfaces and the surfaces of irregularly shaped objects. In this technique, the inked image is lifted from an engraved printing plate and is transferred to the surface to be printed by means of a resilient transfer pad, generally consisting of silicone rubber. The surface characteristics of the silicone rubber are such that the ink easily releases from the pad and preferentially adheres to the print receiving surface. The ability of the transfer pad to elastically deform during printing allows virtually any type of raised or irregularly shaped surface to be printed, in addition to flat surfaces. The process also lends itself to "wet on wet" printing of multicolor images, since the ink-repellent pad has no tendency to pick up a previously deposited ink image from the substrate when the next color is being printed.

Various types of automatic printing machines employing the pad transfer process have been developed. Genrally, these machines employ an engraved printing plate which is held in a face-up position at or near the base of the machine. The article to be printed is usually held at an adjacent work station with its print-receiving surface also facing upwardly. The transfer pad is held at an elevated position above the machine base and is arranged to move back and forth in a horizontal direction between the printing plate and the surface to be printed. At the end points of its horizontal travel, the transfer pad reciprocates vertically so as to be brought first into contact with the printing plate and then into contact with the print-receiving surface. The mechanical linkage which moves the transfer pad along the desired path is usually interconnected with a separate mechanism that is used for inking and scraping the printing plate, so that the plate is automatically re-inked and scraped during each printing cycle. The inking step involves flooding the printing plate with ink taken from a trough or reservoir by means of a brush, spreader blade, wire applicator, or the like. A doctor blade or other type of wiping or scraping device is then employed to remove excess ink from the plate, so that the ink remains only in the grooves or depressions which define the legend to be printed.

With presently available pad transfer printing machines, some difficulty is encountered in removing the printing plate for cleaning or legend changes. This difficulty arises in part from the fact that the printing plate is usually mounted on or near the base of the machine, beneath the pad mechanism and the linkages used for operating the inking and scraping devices. The operator must reach through or under these mechanisms in order to gain access to the printing plate, and, as a result, removal of the plate cannot be accomplished as quickly and conveniently as might be desired. Apart from the problem of access, however, there is a further difficulty in that the printing plate being removed will usually be covered with ink from the previous printing cycle. This is a consequence of the fact that most automatic pad transfer machines, when operating in an intermittent mode or when interrupted during continuous operation, are designed to stop at a predetermined home position in which the printing plate is left in a flooded condition (i.e., covered with ink but not yet scraped or doctored). If this were not so, residual ink left in the etched grooves of the plate would dry out if the machine were allowed to remain in the home position for an extended period of time without removing the plate. Hence it is necessary, when removing the printing plate for the purpose of cleaning or legend changes, to handle the plate in a flooded condition until the ink can be cleaned off. Even for experienced operators, it is difficult to remove the flooded plate without having the ink spill and soil the operator's hands, clothing and work area. This is disadvantageous not only because of the untidiness of the spilled ink, and the time and inconvenience involved in removing it, but also because a significant amount of ink is wasted. There is also a tendency for the ink on the surface of the plate to drip or spill onto the underlying portion of the machine base, on which the plate rests, as the plate is being removed. The ink which accumulates in this area can interfere with the proper seating of a new plate and can also impede later removal of the plate once the ink has dried. This situation can be remedied to some extent by cleaning the plate supporting area of the machine base after the plate is removed, but this creates additional inconvenience for the operator and increases the amount of time involved in changing the printing plate.

SUMMARY OF THE INVENTION

In accordance with the present invention, the foregoing limitations and disadvantages of the prior art are substantially avoided by providing a pad transfer printing machine in which the engraved printing plate is suspended at an elevated position above a surface to be printed, with the engraved surface of the plate facing downwardly. The printing plate is arranged for back and forth movement between two horizontally separated positions, which are referred to as the pad contacting position and the retracted position, respectively. The printing machine is provided with means for inking the printing plate and for removing excess ink therefrom during movement of the plate between the pad contacting and retracted positions. The printing machine is further provided with a movable printing member which carries a deformable transfer pad for transferring inked images from the printing plate to the surface to be printed. The printing member is arranged to move the transfer pad upwardly and downwardly between the printing plate and the surface to be printed, and to invert the transfer pad during each upward and downward stroke, so that the transfer pad is alternately brought into contact with the printing plate at the top of its stroke and with the surface to be printed at the bottom of its stroke. A common drive means is provided for synchronously moving the printing plate and the printing member in a manner such that the printing plate is temporarily held stationary at the pad contacting position when the transfer pad is at the top of its stroke.

The arrangement described above is advantageous in that the printing plate is suspended at an elevated position relative to both the surface to be printed and the transfer pad mechanism. As a result, the printing plate can occupy a topmost position in the printing machine, where it is easily accessable to the operator for removal, cleaning and replacement. Unlike previously available pad printing machines in which the printing plate is mounted in a face-up position at or near the machine base, it is not necessary for the operator to reach through or under the pad mechanism to gain access to the printing plate.

Further in accordance with the present invention, the means for inking the printing plate and for removing excess ink therefrom comprises, first, ink supply means suspended below the printing plate for applying ink to the engraved surface of the printing plate and, second, ink removal means suspended below the printing plate for removing excess ink from the plate and for returning the excess ink by gravity to the ink supply means. The printing plate is adapted to be removable from the printing machine, and, during such removal of the plate, the ink removal means is effective to remove excess ink from the printing plate and to return the excess ink by gravity to the ink supply means. As a result of this arrangement, removal of the printing plate from the printing machine will automatically result in the plate being stripped of excess ink by the ink removal means. Hence it is not necessary for the operator to handle the printing plate in a flooded condition when it is desired to remove the plate for cleaning or legend changes. Problems of ink spillage are largely avoided, and, as a result, the time required for a plate change operation is greatly reduced. A further advantage is that little or no ink is wasted during the plate change operation, since the ink which is stripped from the plate during its removal is automatically returned to the ink supply for use during subsequent printing cycles.

Additional aspects of the present invention reside in the drive mechanisms for the printing member, printing plate, and for the ink supply and removal means, as well as in the construction and mounting of the ink supply and removal means, as will be described hereinafter.

BRIEF DESCRIPTION OF THE DRAWINGS

The various objects, advantages and novel features of the invention will be more readily understood from the following detailed description when read in conjunction with the appended drawings, in which.

Throughout the drawings, like reference numerals will be understood to refer to like parts.

DETAILED DESCRIPTION OF THE PREFERRED EMBODIMENT

Figure 1:
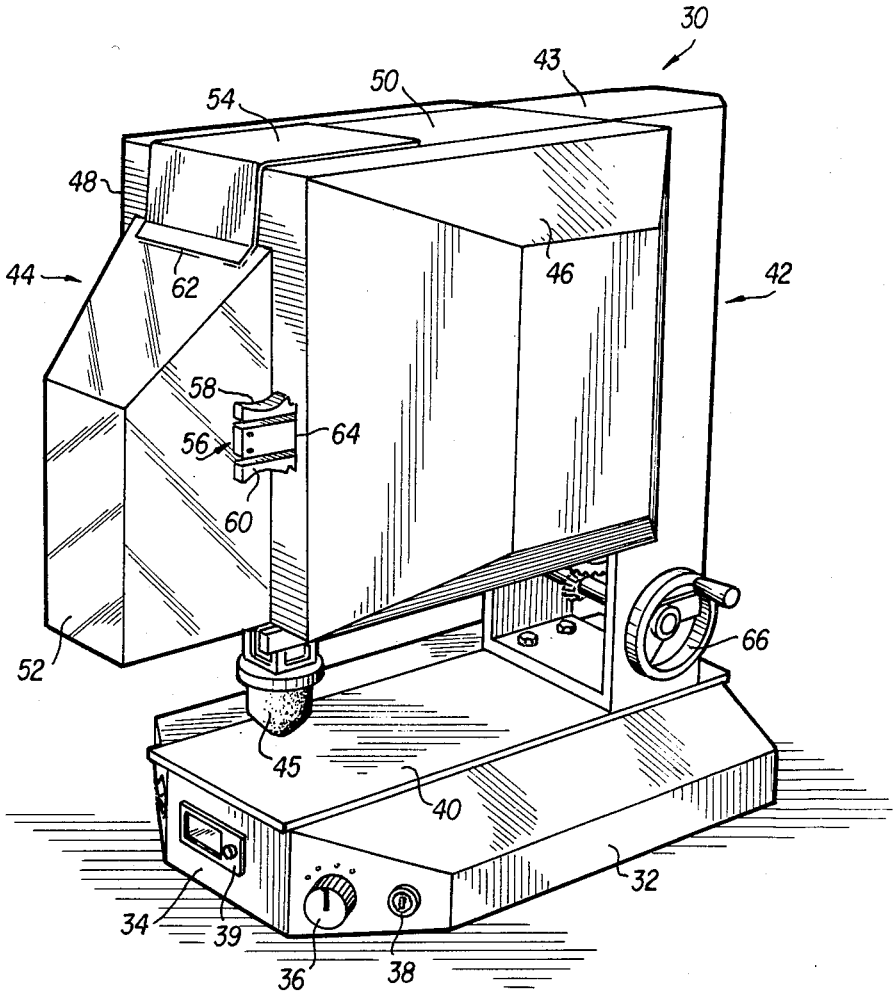
FIG. 1 is a right side perspective view of a pad transfer printing machine constructed in accordance with the present invention, shown with various protective covers in place.

FIG. 1 illustrates a preferred embodiment of a pad transfer printing machine 30 constructed in accordance with the present invention. The printing machine 30 includes a machine base 32 which houses the electronic circuit boards used to control the operation of the machine. The circuit boards are held in a slide-out drawer 34 which can be removed from the machine base 32 when servicing or adjustment is required. The front surface of the slide-out drawer 34 serves as a control panel for mounting various electrical components, including a motor speed control knob 36, a fuse 38 and an electronic counter display 39. A work table 40 is mounted on top of the machine base 32 and serves as a support surface for the articles to be printed (not shown in FIG. 1). A rear column 42, shown with a rear cover 43 in place, is affixed to the rear portion of the work table 40. The rear column 42 is generally in the form of an upright rectangular frame and provides a fixed support for the movable print head section 44 of the printing machine 30. The print head section 44 contains internal frames for supporting the mechanism used to reciprocate the resilient transfer pad 45 as well as the mechanisms used for driving the printing plate and ink reservoir. In FIG. 1, these mechanisms are obscured from view by a set of protective covers which include a convex right side cover 46, a similarly shaped left side cover 48, and a flat top cover 50. A transparent lower door 52 is provided at the front of the machine to allow access to the transfer pad mechanism. The door 52 has a convex shape to allow clearance for the arcuate path of the transfer pad 45 as the pad moves back and forth between the printing plate, which is held in the top of the printing machine, and the article to be printed. A transparent upper door 54 provides access to the top-mounted printing plate and adjacent ink reservoir. The lower door 52 is hinged along its left-hand edge and is held closed by a one-piece plastic latch 56 which is formed with flexible upper and lower arms 58, 60. The latch 56 includes a rearwardly projecting portion which engages a rectangular slot 64 formed in the forward surface of the right side cover 46. The flexible upper and lower arms 58, 60 can be squeezed toward each other to disengage the latch from the slot 64 when it is desired to open the lower door 52 to gain access to the pad mechanism. The upper L-shaped door 54 is hinged along its rear edge and is formed with a forward lip 62 which is received in a cut-out located along the top edge of the lower door 52. The upper door 54 is opened by the operator when it is desired to remove the printing plate and/or the ink reservoir. Electrical interlock devices (not shown) are provided at each of the doors 52, 54 in order to initiate immediate stoppage of the printing machine 30 in the event that either door is opened while the machine is in operation.

With continued reference to FIG. 1, the print head section 44 as a whole is vertically adjustable relative to the fixed rear column 42 by means of a hand crank 66. This allows the downward limit of motion of the resilient transfer pad 45 to be adjusted relative to the work table 40, so that articles of different heights can be printed. It can be appreciated from FIG. 1 that the print head section 44 is mounted in a cantilever fashion from the rear column 42, thereby avoiding any obstruction of the work table 40 in the horizontal or side-to-side direction. This provides the printing machine 30 with a horizontal "throat" of infinite dimension, allowing articles of essentially unlimited length to be printed.

Figure 2:
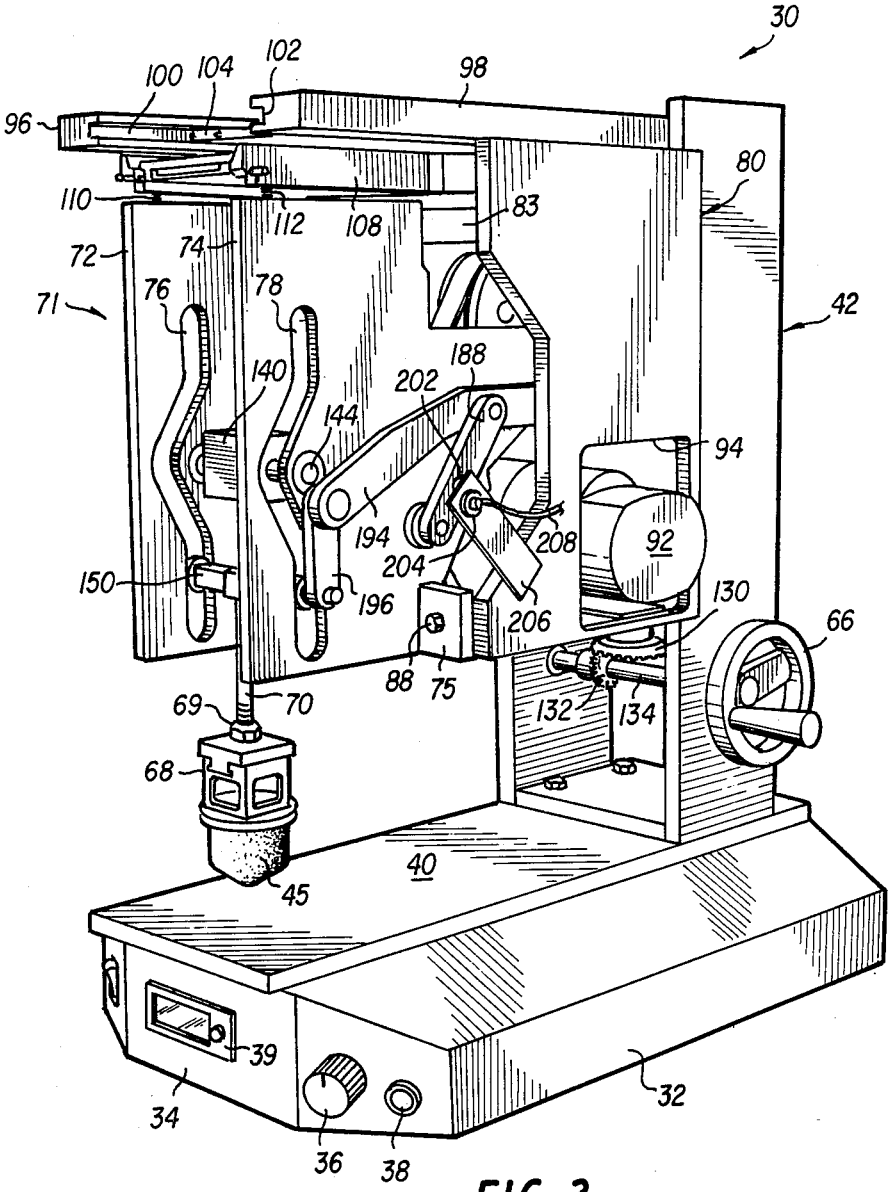
FIG. 2 is a right side perspective view of the printing machine, with the protective covers removed to illustrate certain internal components.
Figure 3:
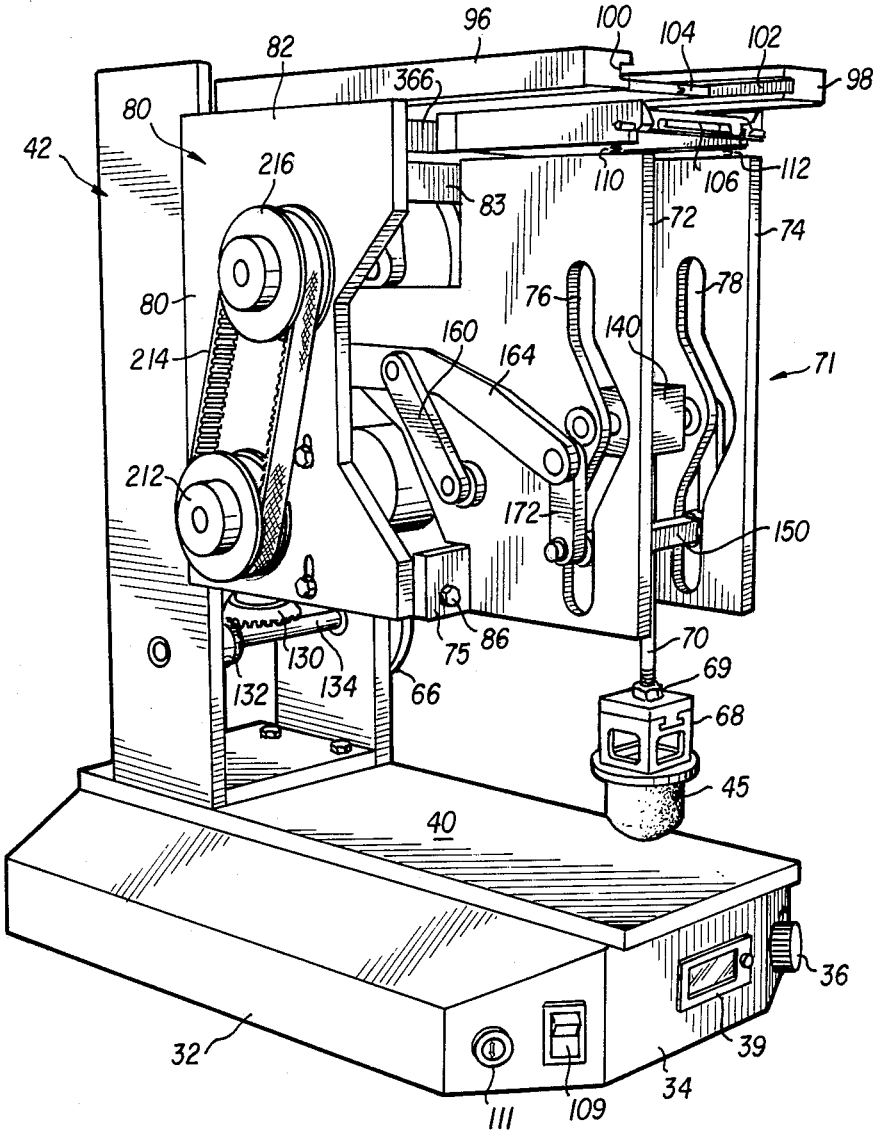
FIG. 3 is a left side perspective view of the printing machine, also shown with the protective covers removed.

Referring now to FIGS. 2 and 3, the printing machine 30 is illustrated in perspective with the covers 46, 48, 50 and doors 52, 54 removed in order to illustrate certain internal details of the machine. The resilient transfer pad 45, which is preferably made of silicone rubber, is secured to an attachment device 68 which is in turn carried by a rod-like plunger 70. The lower portion of the plunger 70 is threaded to receive the attachment device 68, and a check nut 69 holds the attachment device at a selected position on the end of the plunger. By virtue of a mechanical linkage which will be described in some detail hereinafter, the plunger 70 is caused to move in such a way as to drive the transfer pad 45 in alternating upward and downward strokes and to invert the transfer pad during each upward and downward stroke. The pad linkage is carried by an inner frame 71 which includes a pair of parallel, spaced-apart vertical plates 72, 74. The vertical plates 72, 74 are connected to each other by upper and lower cross-members 73, 75 (visible in FIGS. 12 and 13) and are formed with aligned slots 76, 78 which serve as cam tracks for guiding the motion of the pad mechanism. The inner frame 71 as a whole is partially nested in, and is carried by, a somewhat wider outer frame 80. The outer frame 80 is a casting which includes a pair of parallel vertical walls 82, 84 connected together by means of internal cross-members. The upper cross-member 83 is partially visible in FIGS. 2 and 3, while the lower cross-member 85 can be seen in cross-section in FIGS. 12 and 13. The upper and lower cross-members 73, 75 of the inner frame 71 are attached to the correspondingly positioned cross-members 83, 85 of the outer frame 80 by means of an upper bolt 87 (visible in FIGS. 12 and 13) and a pair of lower bolts 86, 88 in order to join the two frames together. The outer frame 80 carries the various drive mechanisms which are used to operate the printing machine 30, with the exception of the pad linkage that is carried by the inner frame 71. The main drive motor 92 of the printing machine is among the items carried by the outer frame 80. Due to its length, the motor housing projects through a rectangular cut-out 94 formed in the right-hand vertical wall 84 of the outer frame. The outer frame 80 is supported by the rear column 42 of the printing machine 30 and, as already noted, is vertically adjustable relative to the rear column in order to allow printing height adjustments to be made. The mechanism used for making these adjustments will be described in more detail shortly. The use of separate inner and outer frames 71, 80 simplifies the assembly and servicing of the printing machine 30 considerably, since the entire pad mechanism is carried by the inner frame 71 which may be installed or removed in one piece.

With continued reference to FIGS. 2 and 3, a pair of stationary horizontal tracks or guideways 96, 98 are affixed to the top of the outer frame 80 and extend in a forward direction over the inner frame 71. The guideways 96, 98 are formed with grooves or channels 100, 102 for receiving a slidable printing plate carriage 104, which is shown in its retracted position in FIGS. 2 and 3. During the operation of the printing machine 30, the plate carriage 104 is caused to slide back and forth along the horizontal path established by the guideways 96, 98, in synchronism with the upward and downward strokes of the plunger 70 and transfer pad 45. The printing plate is held in a face-down orientation by the plate carriage 104 and is inked and scraped at the appropriate times by an ink reservoir 106 which is suspended below the path of movement of the plate carriage. The ink reservoir 106 is carried by a U-shaped holder 108 which is supported from the parallel vertical walls 82, 84 of the outer frame 80. The reservoir holder 108 is pivotable about a horizontal axis extending in a direction perpendicular to the outer frame walls 82, 84, allowing the ink reservoir 106 a limited degree of vertical movement toward and away from the path of movement of the plate carriage 104. The forward ends of the U-shaped reservoir holder 108 are supported by coil springs 110, 112 which are affixed to the top edges of the inner frame plates 72, 74, respectively. The springs 110, 112 serve to urge the holder 108, and hence the ink reservoir 106, in an upward direction toward the plate carriage 104.

FIG. 3 also illustrates two additional electrical components which are mounted on the front surface of the slide-out drawer 34 of the machine base, namely, a rocker-type power switch 109 and a second fuse 111. These components are in addition to the motor speed control knob 36, fuse 38 and counter display 39 shown in FIGS. 1 and 2.

Figure 4:
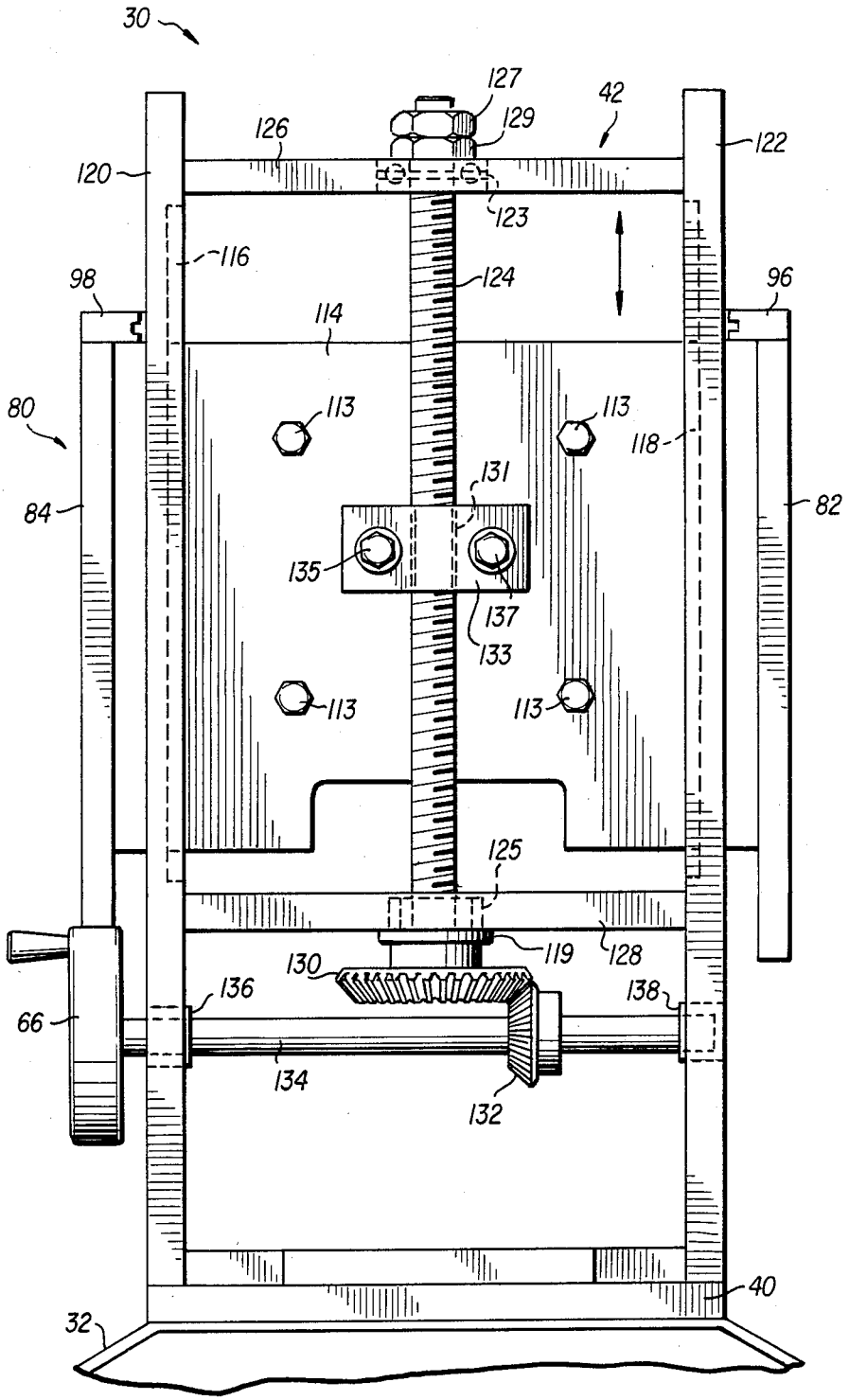
FIG. 4 is a rear elevational view of the printing machine, illustrating the mechanism used for raising and lowering the pad mechanism relative to the machine base in order to allow printing height adjustments to be made.

FIG. 4 is a rear view of the printing machine 30, also with the covers removed, illustrating the mechanism used for raising and lowering the outer frame 80. The rear part of the outer frame 80 is affixed by a number of bolts 113 to a movable back plate 114, which is carried by the rear column 42. The back plate 114 is slidably received in vertical tracks or grooves 116, 118 formed in the side plates 120, 122 of the rear column. A threaded shaft 124 extends vertically in the space between the side plates 120, 122 and is rotatably supported at its upper and lower ends by bearings 123, 125 seated in horizontal cross-members 126, 128, respectively, these cross-members being affixed between the side plates 120, 122 and forming a part of the rear column 42. The lower bearing 125 is a conventional radial bearing with a flange 119 held in contact with the underside of the lower cross-member 128. The upper bearing 123 is a thrust bearing to which the upper end of the threaded rod is coupled by means of a pair of nuts 127, 129. The thrust bearing 123 supports the weight of the print head section 44 of the printing machine 30, including the weight of the inner and outer frames 71, 80 and the various components carried by these frames. The intermediate portion of the threaded rod 124 passes through a threaded hole 131 in a bracket 133, which is affixed by a pair of bolts 135, 137 to the back plate 114. The lower end of the threaded shaft 124 projects through the bearing 125 and carries a first bevel gear 130. The bevel gear 130 meshes at right angles with a second bevel gear 132 that is affixed to a horizontal shaft 134. The shaft 134 is rotatably carried by the side plates 120, 122 of the rear column by means of bearings 136, 138. One end of the shaft 134 projects through the side plate 120 of the rear column and is affixed to the rotary hand crank 66 shown in the earlier views. When it is desired to raise or lower the pad mechanism, the hand crank 66 is rotated and this rotation is transmitted by the shaft 134 and bevel gears 130, 132 to the vertical threaded shaft 124. The rotation of the threaded shaft 124 within the internally threaded bracket 133 will cause the bracket, and hence the back plate 114 to which it is affixed, to move vertically up or down. Referring for a moment to FIGS. 2 and 3, the vertical movement of the back plate 114 will cause the entire outer frame 80 and the attached inner frame 71 to shift up or down, thereby allowing the height of the transfer pad 45 to be adjusted as described earlier. With reference to FIG. 1, the outer covers 46, 48, 50 and doors 52, 54 are secured directly or indirectly to the outer frame 80 and inner frame 71, and therefore, will also shift vertically relative to the rear column 42 when the printing height is adjusted.

In the preferred embodiment, the print head section 44 of the printing machine 30 is an independent component which may be separated from the rear column 42 and the machine base 32 in situations where the latter components are not necessary. As an example, the print head 44 may be supported from an existing frame structure in a product manufacturing plant, and used to print on products carried on a moving conveyor system.

Figure 5:
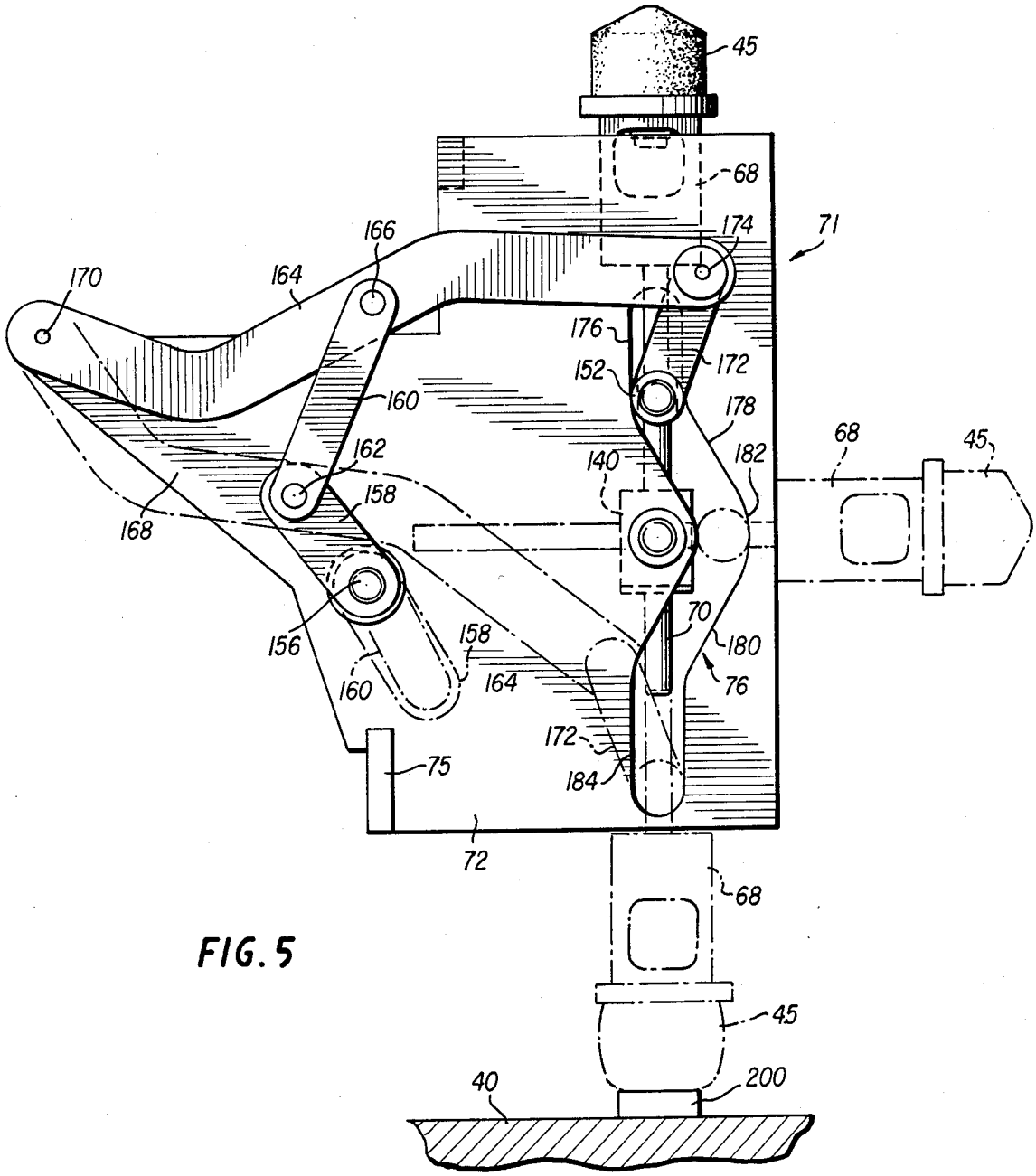
FIG. 5 is a side view of the inner frame portion of the printing machine, illustrating three different positions of the transfer pad mechanism.

The operation of the reciprocating pad mechanism will now be explained with reference to FIGS. 5 and 6, although reference may also be had to the perspective views of FIGS. 2 and 3, discussed previously. In the interest of clarity, FIG. 5 illustrates the pad mechanism and inner frame in isolation, with the remaining portions of the printing machine deleted. In the front view of FIG. 6, the outer frame, plate holder and ink reservoir have been shown in order to illustrate the positions of these components with respect to the pad mechanism. As previously noted, the transfer pad 45 is carried at one end of a rod-like plunger 70 by means of an attachment device 68. The plunger 70 is axially reciprocable through a pivot block 140 by means of a linear bearing 141 carried within the pivot block. The pivot block 140 is supported by a pair of shoulder screws 142, 144 and is pivotable about a horizontal axis which is perpendicular to the axis of the plunger 70. The head portions of the shoulder screws 142, 144 are journalled in the respective vertical plates 72, 74 of the inner frame 71 by means of flange bearings 143, 145 and have their threaded ends rigidly received in threaded holes formed in opposite faces of the pivot block 140. In this way, the pivot block 140 and shoulder screws 142, 144 pivot as a unit about a horizontal axis defined by the axes of the two bolts. A spring 146 is disposed around the shank of the shoulder screw 142 and is maintained in compression between a spacer 147 held in contact with the bearing 143, and the left-hand face of the pivot block 140. On the right-hand side of the pivot block 140, a cylindrical spacer 148 is carried by the shank of the shoulder screw 144 and is held tightly between the right-hand face of the pivot block 140 and the bearing 145, as a result of the force exerted by the spring 146. By virtue of this arrangement, a precise centering of the pivot block 140 is obtained automatically, as long as the cylindrical spacer 148 is of the proper length. It is important that the pivot block 140 and the plunger 70 be properly centered, in order to assure proper alignment between the transfer pad 45 and the plate carriage 104.

Figure 6:
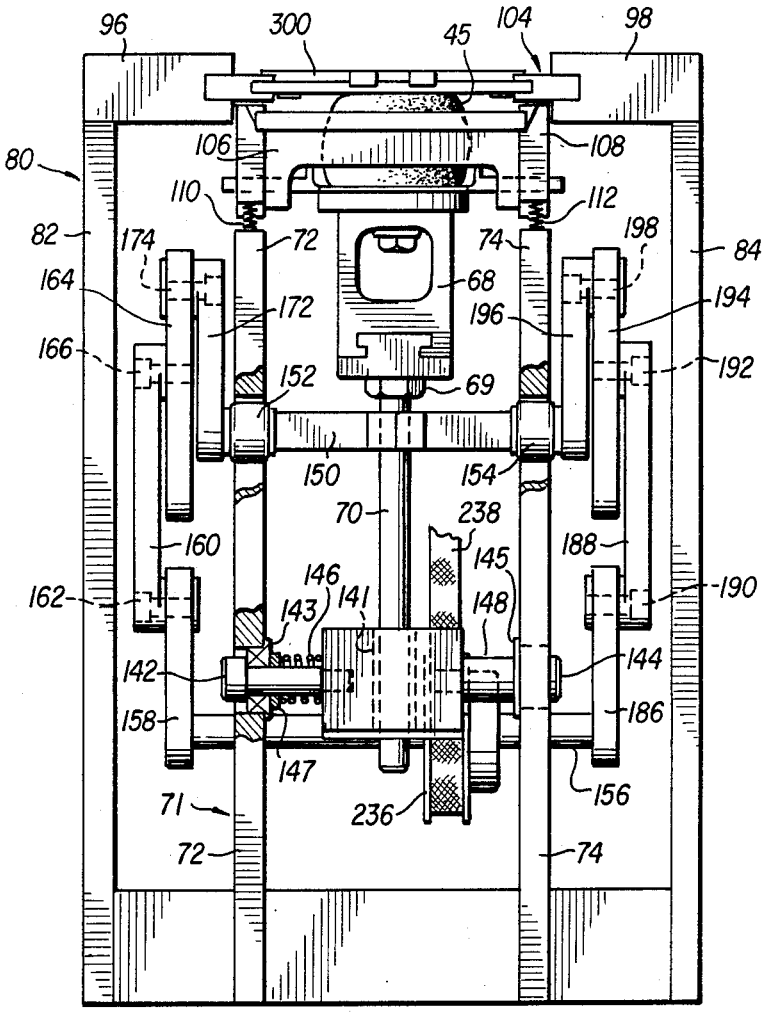
FIG. 6 is a front view of the internal components of the printing machine, illustrating the pad mechanism in the fully raised position.

Still referring to FIGS. 5 and 6, and also to FIGS. 2 and 3, previously discussed, the portion of the rod-like plunger 70 between the transfer pad 45 and the pivot block 140 is rigidly affixed to a movably mounted cross-member 150. The cross-member 150 is mounted perpendicularly to the plunger 70, and is parallel to and spaced from the pivot axis of the pivot block 140. The ends of the cross-member 150 carry bearings 152, 154 which serve as cam followers. The cam followers 152, 154 are received in the respective cam tracks 76, 78 of the inner frame plates 72, 74 for guiding the motion of the cross-member 150. The mechanism employed for causing the cross-member 150 to move in the path defined by the cam tracks 76, 78 is perhaps best illustrated in FIG. 5, which depicts one side of the inner frame 71 in isolation; however, it should be understood that a substantially identical arrangement is employed on the opposite of the inner frame, as will be evident from FIGS. 2 and 6. Referring to FIG. 5, a shaft 156 is journalled for rotation in the vertical side plate 72 of the inner frame and is rigidly connected to a crank 158. The end of the crank 158 is connected to a drive link 160 by means of a pivotal connection 162. The drive link 160 is connected to an intermediate point on a horizontal drive arm 164 by means of a further pivotal connection 166. The horizontal drive arm 164 is connected at one end to a generally triangular extension 168 of the inner frame plate 72 by means of a pivotal connection 170. In the assembled condition of the printing machine, the triangular extension 168 and the corresponding extension of the right-hand inner frame plate 74 are received between the vertical frame walls 82, 84 of the outer frame 80. The opposite end of the horizontal drive arm 164, in the direction toward the front of the printing machine 30, is connected to one end of a short drive link 172 by means of a pivotal connection 174. The opposite end of the short drive link 172 is pivotally connected to the inner race of the cam follower 152 and to one end of the movable horizontal cross-member 150. In operation, the shaft 156 rotates the crank 158 in a counter-clockwise direction, as indicated by the arrow. With each full rotation of the crank 158, the bottom of the drive link 160 undergoes a circular motion and the top of this link, which is pivotally affixed to the horizontal drive arm 164, is moved downwardly and upwardly in a reciprocating manner. This reciprocating motion is transmitted to the horizontal drive arm 164, causing the forward end of the drive arm to execute alternating downward and upward strokes as the opposite end of the arm pivots about the pivotal connection 170. This motion is transmitted by the short drive link 172 to the cam follower 152 and horizontal cross-member 150. As a result, the cam follower 152 is driven downwardly and upwardly within the cam track 76, causing the horizontal cross-member 150 to follow the same path. The cam track 76 includes a straight upper portion 176, a pair of oppositely inclined portions 178, 180 joined by a smoothly curved central area 182, and a straight lower portion 184. The cam track 78 in the right-hand inner frame plate 74 has the same shape as the cam track 76, and the two cam tracks 76, 78 are in alignment with each other both horizontally and vertically as can be appreciated from FIGS. 2 and 3. As a result, the cross-member 150 is held in a perfectly horizontal orientation and the two cam followers 152, 154 are at the same relative positions in their respective cam tracks 76, 78 at all times during the operation of the printing machine. Alignment between the cam tracks 76, 78 is facilitated by the fact that they are formed in the inner frame plates 72, 74 directly, rather than in separate components affixed to the machine frame.

As already noted, the drive linkage illustrated in FIG. 5 is duplicated on the right-hand side of the inner frame 71 to assure that both ends of the horizontal cross-member 150 are driven in the same manner. Thus, with reference to FIG. 6, the shaft 156 drives a second crank 186 which is identical to, and is rotationally aligned with, the crank 158. The end of the crank 186 is pivotally connected to one end of a drive link 188, corresponding to the drive link 160, by means of a pivotal connection 190. The opposite end of the drive link 188 is connected by means of a pivotal connection 192 to an intermediate point on a horizontal drive arm 194, the latter being substantially identical to the drive arm 164. The rear part of the drive arm 194 is pivotally connected to a triangular extension of the right-hand inner frame plate 74, similar to the manner in which the drive arm 164 is pivotally connected to the triangular extension 168 in FIG. 5. The right-side drive linkage is completed by a short drive link 196 which extends from a pivotal connection 198 at the forward end of the horizontal drive arm 194, to a second pivotal connection with the cam follower 154 and horizontal cross-member 150.

The manner in which the drive mechanisms just described produce the desired motion of the transfer pad 45 will now be apparent. Referring again to FIG. 5, let it be assumed that the transfer pad 45 is in the solid line position and the crank 158 is being rotated in a counter-clockwise direction. The transfer pad 45 is carrying an inked image which, during the preceding portion of the printing cycle in progress, has been lifted from the printing plate supported by the plate carriage 104. The cam follower 152 has just completed a straight downward motion in the upper section 176 of the cam track 76, which has caused the plunger 70 to move downwardly through the pivot block 140 and the transfer pad 45 to move downwardly as well. Since as the top portion 176 of the cam track is aligned vertically with the pivot axis of the pivot block 140, no pivoting motion of the plunger 70 and transfer pad 45 has yet occurred. As the crank 158 continues to rotate, however, the short drive link 172 forces the cam follower 152 to move downwardly into the upper inclined section 178 of the cam track 76. While it is in this segment, the cam follower 152 is not only moving closer to the pivot axis of the pivot block 140, causing the plunger 70 to retract further into the pivot block 140, but is also moving rotationally around the axis of the pivot block 140. This latter motion causes the plunger 70, and hence the transfer pad 45, to rotate in a clockwise direction about the horizontal axis of the pivot block 140. When the cam follower 152 reaches the curved section 182 at the center of the cam track 76, the plunger 70 is retracted to the maximum extent with respect to the pivot block 140, and the plunger 70 and transfer pad 45 are both projecting horizontally in the right-hand direction as illustrated in phantom outlines. As the cam follower 152 continues to move downwardly in the cam track, it enters the lower inclined section 180. In this section, the cam follower 152 simultaneously moves further away from the pivot axis of the pivot block 140, causing the plunger 70 to begin to withdraw from the pivot block 140, and executes a further clockwise rotation relative to the axis of the pivot block 140 until the axes of the cam follower 152 and pivot block 140 are again in vertical alignment. This latter rotation causes the plunger to be brought to a vertical position with the transfer pad 45 facing downward. With continued rotation of the crank 158, the cam follower 152 moves downwardly along the lower straight portion of the cam track 76 until it reaches the lowermost point in the cam track. During this motion, the plunger 70 is further withdrawn from the pivot block 140 and the transfer pad 45 is moved vertically downward into contact with an article 200 to be printed. At this point, the crank 158, drive link 160, horizontal drive arm 164, and short drive link 172 are in the lowermost phantom positions of FIG. 5. The resilient transfer pad 45 is deformed somewhat as it is pressed into contact with the article 200 as shown. With further rotation of the crank 158, the cam follower 152 begins to move upwardly in the lower straight portion of the cam track 184, causing the transfer pad to separate from the article 200 and the plunger 70 to retract upwardly through the pivot block 140. At this point, the pad mechanism is in the home position, which defines the end of the printing cycle and the stopping point of the printing machine 30 if the machine is being operated intermittently rather than continuously. At the beginning of the next printing cycle, the cam follower 152 moves upwardly through the lower inclined portion 180 of the cam track. The plunger 70 continues to retract and also pivots upwardly in a counter-clockwise direction. When the cam follower reaches the central curved section 182, the plunger 70 is fully retracted into the pivot block 140 and the transfer pad 45 is projecting horizontally outward in the same direction as during the downward stroke (i.e., to the right in FIG. 5). As the cam follower 152 moves upward along the upper inclined section 178 of the cam track, the plunger begins to withdraw from the pivot block 140 and the plunger 70 and transfer pad 45 continue to pivot in a counterclockwise direction toward the vertical position. The cam follower 152 then moves upward along the straight upper portion 176 of the cam track, causing the plunger to extend further from the pivotal block 140 and thereby moving the transfer pad 45 to its fully raised position. In this position, the transfer pad is pressed into contact with the engraved printing plate held by the plate carriage 104, and, as a result, some distortion of the transfer pad will occur as illustrated in FIG. 6. The pressure exerted by the pad 45 on the printing plate can be adjusted by screwing the attachment device 68 upwardly or downwardly along the threaded portion of the plunger 70. After the pad 45 is brought into contact with the printing plate to pick up the inked image, the cam follower 152 begins to move downwardly in the upper portion 176 of the cam track, thereby separating the transfer pad from the printing plate and restoring the mechanism to the solid line position in FIG. 5.

During the actual operation of the printing machine 30, the pad mechanism is designed to stop at a predetermined home position when the machine is operating in an intermittent mode, as already mentioned. The machine will also stop at the home position when it is interrupted during continuous operation. The home position occurs during the initial part of the upward stroke of the transfer pad 45, when the transfer pad has separated from the article 200 after printing and the cam follower 152 has arrived approximately at the intersection between the lower straight portion 184 and the lower inclined section 180 of the cam track 76. With the transfer pad 45 in the home position, the printed article 200 can be removed and a new article can be moved into position for printing. FIGS. 2 and 3 illustrate the transfer pad 45, together with the various components of the pad mechanism, in the home position. The home position is sensed by the alignment of a magnet 202 (visible in FIG. 2) on the right-hand drive link 188 with an electrical Hall-effect switch 204. The switch 204 is mounted on a strip-like support 206 which is attached to the right-hand vertical plate 84 of the inner frame 80. Wires 208 connect the sensor 204 to the electrical control system of the printing machine 30. When the drive link moves to a position at which the magnet 202 aligns with the switch 204, the control system immediately brakes the motor 92 in order to stop the pad mechanism in the home position. The details of the electrical control system will be discussed further in connection with FIGS. 27–29.

Figure 7:
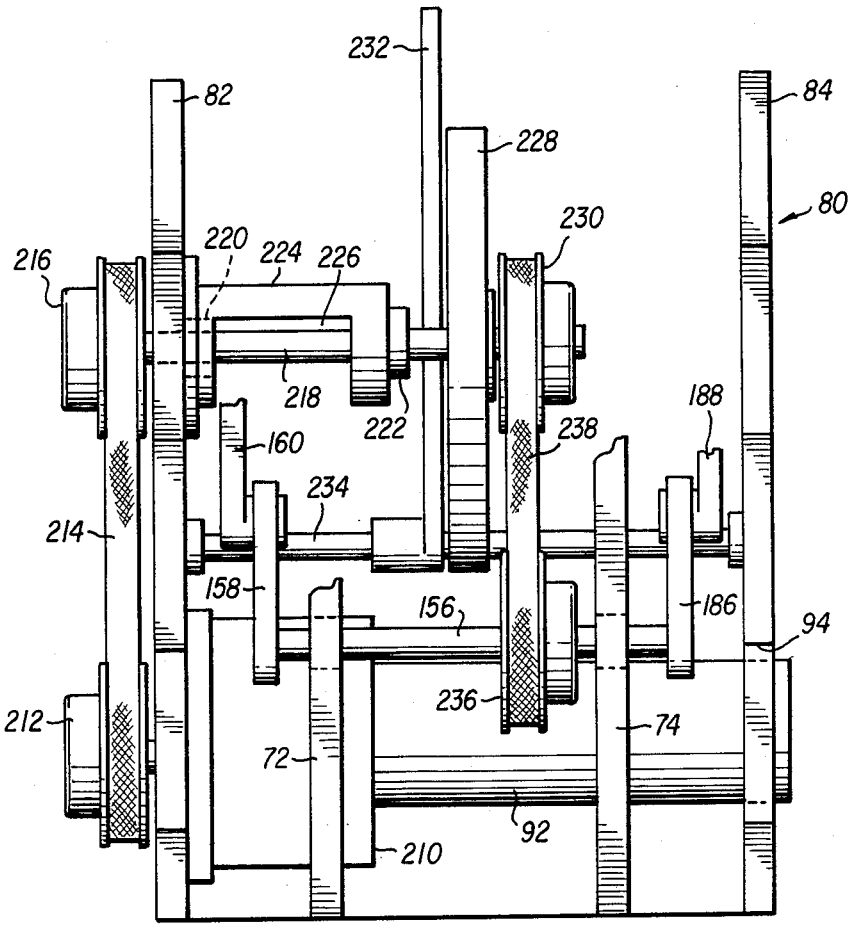
FIG. 7 is a front view of the interior portion of the printing machine behind the pad mechanism, illustrating the interconnected drive systems for operating the pad mechanism, ink reservoir and printing plate.

FIG. 7 is a front interior view of the printing machine 30 with the inner frame 71 partially cut away to illustrate the components carried by the outer frame 80. The main drive motor 92 is situated in the lower part of the inner frame and is connected to a gear reducer 210. The gear reducer 210 is mounted on the inside surface of the left-hand inner frame plate 82. The output shaft of the gear reducer 210 projects through the plate 82 and is connected to a timing belt pulley 212. A timing belt 214 connects the pulley 212 to a second pulley 216 located above and somewhat ahead of the first pulley, as can be appreciated by reference to FIG. 3. The pulley 216 drives a shaft 218 which extends through the plate 82 and into the area within the inner frame 80. The shaft 218 is rotatably supported in a cantilever fashion by first and second bearings 220, 222 carried at the ends of a cylindrical support device 224. The cylindrical support device 224 is affixed by screws (not shown) to the inside surface of the side wall 82 and is formed with a cut-out section 226 to provide clearance for the vertical plate 72 of the inner frame, which is shown partially cut away, and also for the horizontal drive arm 164 of the pad linkage. The portion of the shaft 218 which extends in the right-hand direction from the support device 224 is rigidly connected to a cam 228 and a timing belt pulley 230. The purpose of the cam 228 is to control the movements of the plate carriage 104 and ink reservoir holder 108, in a manner which will be described in more detail hereinafter. The plate carriage 104, ink reservoir holder 108, and their associated components have been omitted from FIG. 7 for clarity, although the vertical drive arm 232 that reciprocates the plate carriage 104 is shown. The lower end of the drive arm 232 is affixed to a rotatable shaft 234 which extends between the two vertical side walls 82, 84 of the inner frame 80. The intermediate part of the drive arm 232 carries a follower (not shown) which rides in a groove or channel formed in the left side face of the cam 228. As a result, the rotation of the shaft 234 about its axis reciprocates the drive arm 232 forward and backward (i.e., perpendicular to the page in FIG. 7) under the control of the cam 228. The timing belt pulley 230 is coupled to a second timing belt pulley 236 by means of a timing belt 238, and functions to transmit rotary power from the shaft 218 to the shaft 156. The shaft 156 is rotatably supported by the vertical side plates 72, 74 of the inner frame and is connected at its ends to the cranks 158, 186 which drive the pad mechanism as previously described. The gap between the right-hand end of the shaft 218 and the right side wall 84 of the inner frame 80, resulting from the cantilever mounting of the shaft 218 by the device 224, allows the timing belt 238 to be removed from the pulley 230 when servicing or replacement is required.

Figure 8:
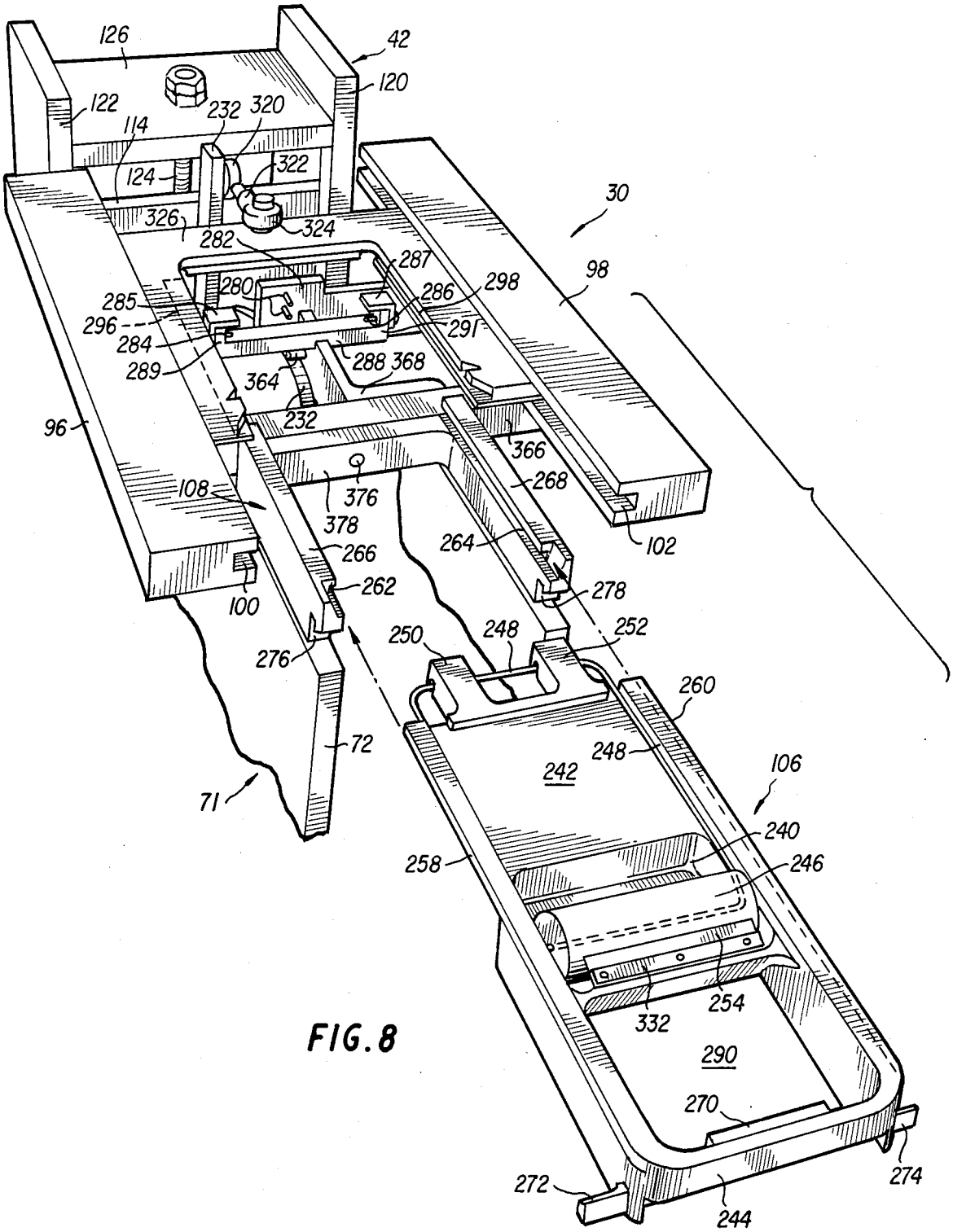
FIG. 8 is an exploded view illustrating the manner in which the removable ink reservoir is received in the printing machine.

FIG. 8 is an exploded view illustrating the manner in which the ink reservoir 106 is received in the top portion of the printing machine 30. The ink reservoir 106 is an elongated metal casting, which comprises a central trough 240, a rear plate portion 242, and a forward U-shaped handle portion 244. A supply of ink (not shown) is held in the trough 240 and is applied to a freely rotatable inking roller 246. The inking roller is suspended by a rectangular wire form 248 in a manner such that the inking roll has its lower surface immersed in the ink contained in the trough 240. The surface of the inking roller 246 may be formed with axial or circumferential grooves to assist in retaining a layer of ink. The rear part of the wire form 248 is retained by grooves formed in the underside of a pair of tabs 250, 252 extending rearwardly from the plate portion 242. A removable doctor blade 254 is positioned just ahead of the inking roller 246. The ink reservoir 106 is formed with horizontal flanges 258, 260 which are received in inwardly facing grooves 262, 264 formed in the right and left-hand arms 266, 268 of the reservoir holder 108. This arrangement permits the ink reservoir 106 to be slidably removed from the printing machine 30 for cleaning, replenishment of the ink supply, replacement of the doctor blade 254, and so on. The forward part of the handle 244 is fitted with a plastic latch 270 which includes two horizontally projecting tabs 272, 274. The tabs 272, 274 engage notches 276, 278 formed beneath the forward ends of the reservoir holder arms 266, 268 in order to lock the reservoir 106 in position. When the ink reservoir 106 is installed, the rear portion of the wire form 248 is captured between a pair of horizontally extending pins 280 which are affixed to a stationary horizontal bracket 282. The bracket 282 is connected to the right-hand wall 84 of the inner frame 80. The rear side portions of the wire frame 248 are captured between a set of pins 284, 286 and upper L-shaped retainers 285, 287 which are affixed to upright sections 289, 291 at the ends of a movable member 288. As will be described in more detail hereinafter, the movable member 288 is part of a follower structure which is reciprocated vertically by the cam 228 of FIG. 7. The purpose of the pins 280, 284, 286 and upper retainers 285, 287 is to cause the wire form 248, and hence the inking roll 246, to move vertically up and down relative to the body of the ink reservoir 106 so that ink is applied to the underside of the printing plate (not shown) only at the proper times during the operating cycle of the printing machine.

Figure 9:
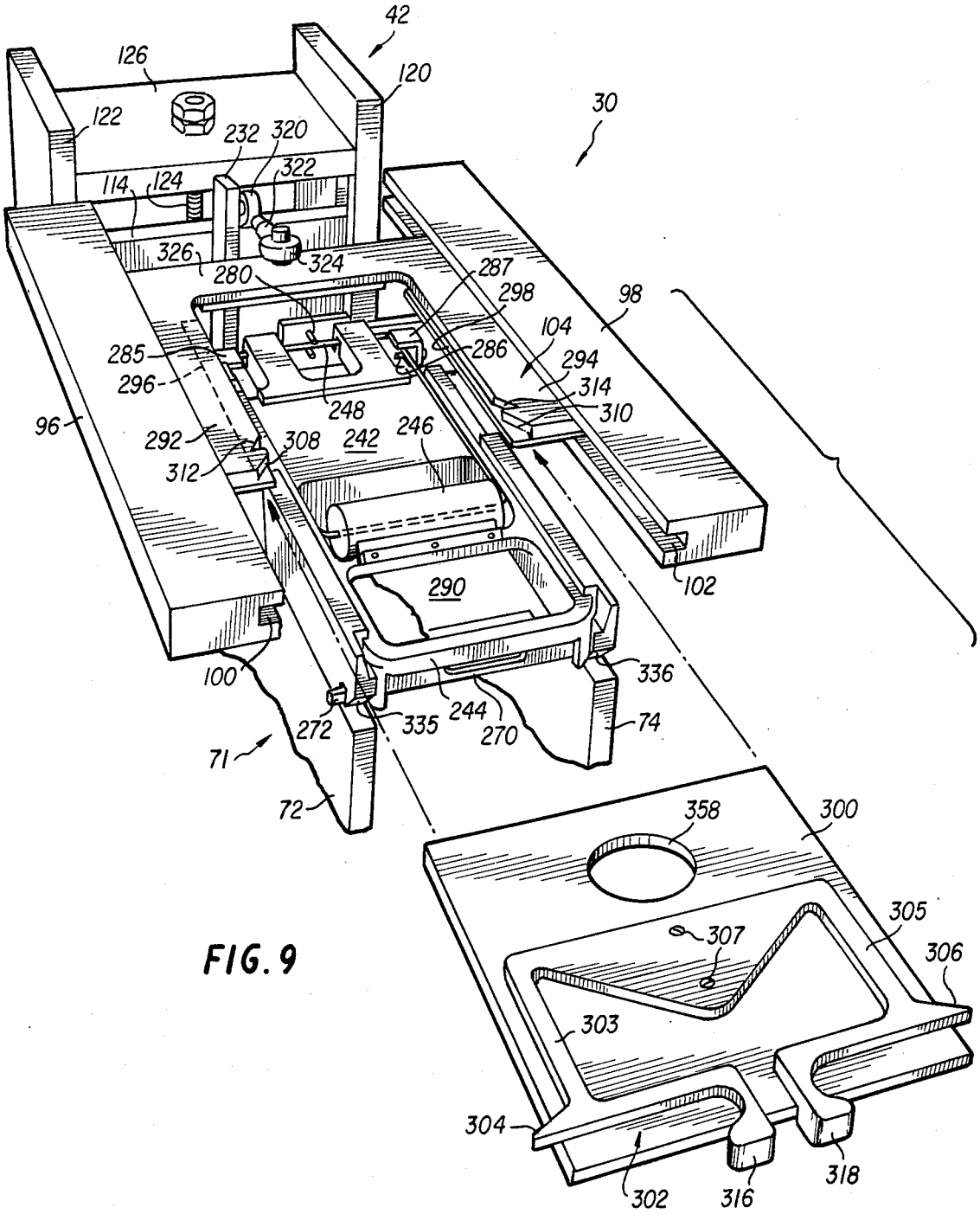
FIG. 9 is an exploded view similar to FIG. 8, illustrating the manner in which the removable printing plate holder is received in the printing machine.

In FIG. 9, the ink reservoir 106 is shown installed within the printing machine 30. It will be observed that the rear portion of the wire form 248 is held between the stationary pair of pins 280, and therefore cannot move vertically. The rear side portions of the wire form 248 are held between the opposed pins 284, 286 and upper retainers 285, 287 which, as noted previously, are mounted on a vertically movable member. It can be readily seen that an upward movement of the side pins 284, 286 and retainers 285, 287, with the rear pins 280 remaining stationary, will force the forward part of the wire form 248 and hence the inking roller 246 to shift or pivot upwardly relative to the body of the ink reservoir 106. Conversely, a downwardly movement of the side pins 284, 286 will force the inking roller 246 to shift downwardly relative to the body of the ink reservoir. The vertical movement of the inking roller 246 results from a pivoting motion of the wire form 248 about the axis of the rear part of the wire form, which is held stationary between the rear pins 280. It will also be noted from FIG. 9 that the handle portion 244 of the ink reservoir 106 surrounds an open center section 290 which is located on top of, and immediately behind the forward edges of the inner frame plates 72, 74. During the operation of the printing machine 30, the resilient transfer pad 45 passes through the open center section 290 of the ink reservoir handle in order to make contact with the underside of the printing plate.

With continued reference to FIG. 9, the printing plate carriage 104 is seen to comprise a U-shaped member which is slidably mounted in grooves 100, 102 formed in the upper tracks or guideways 96, 98. The left and right-hand arms 292, 294 of the printing plate carriage 104 are themselves provided with inwardly facing grooves 296, 298, for slidably receiving a printing plate holder 300. A plastic latch 302 with flexible arms 303, 305 and triangular side projections 304, 306 is affixed by screws 307 to the top of the plate holder 300 and serves to lock the plate holder in place within the plate carriage 104. Installation of the plate holder 300 is accomplished by inserting its rear edge into the grooves 296, 298 of the plate carriage and then sliding the holder into the plate carriage until the triangular projections 304, 306 are brought into contact with the beveled sections 308, 310 at the forward ends of the grooves. Additional rearward pressure is then exerted on the holder 300 to cause the arms 303, 305 to flex inward and the triangular projections 304, 306 to snap into the notches 312, 314. The plate holder 300 is now locked in place within the plate carriage 104. The plate holder may be removed from the printing machine 30 by squeezing the tabs 316, 318 together in order to disengage the triangular projections 304, 306 from the notches 312, 314, and then sliding the plate holder out of the plate carriage 104. When the protective covers of the printing machine are in place as illustrated in FIG. 1, the upper door 54 provides access to the upper interior portion of the print head section 44 to allow removal of the plate holder 300 and/or the ink reservoir 106.

During operation of the printing machine 30, with the ink reservoir 106 and plate holder 300 in place, the plate holder 300 is held at an elevated position above the ink reservoir 106 and is reciprocated in a back and forth manner by the plate carriage 104. The plate carriage is reciprocated by the vertical drive arm 232, the motion of which is controlled by a cam 228 as mentioned previously in connection with FIG. 7. The upper end of the drive arm 232 is connected by means of a first ball joint 320, a connector 322, and a second ball joint 324, to the rear section 326 of the printing plate carriage 104. The printing plate carriage 104 is shown approximately at its retracted position in FIG. 9, that is, at the position which is closest to the rear of the printing machine 30. The forward strokes of the drive arm 232 causes the plate carriage 104 to move to a forward position in which the forward edges of the plate holder 300 and carriage 104 are just slightly behind the forward edges of the tracks or guideways 96, 98. In this position, which is referred to as the operative or pad contacting position of the plate carriage 104, the printing plate held in the plate holder 300 is the proper position for contact with the resilient transfer pad 45. As noted previously, the transfer pad 45 passes through the open central area 290 of the ink reservoir handle 244 in order to make contact with the downwardly facing surface of the printing plate.

Figure 10:
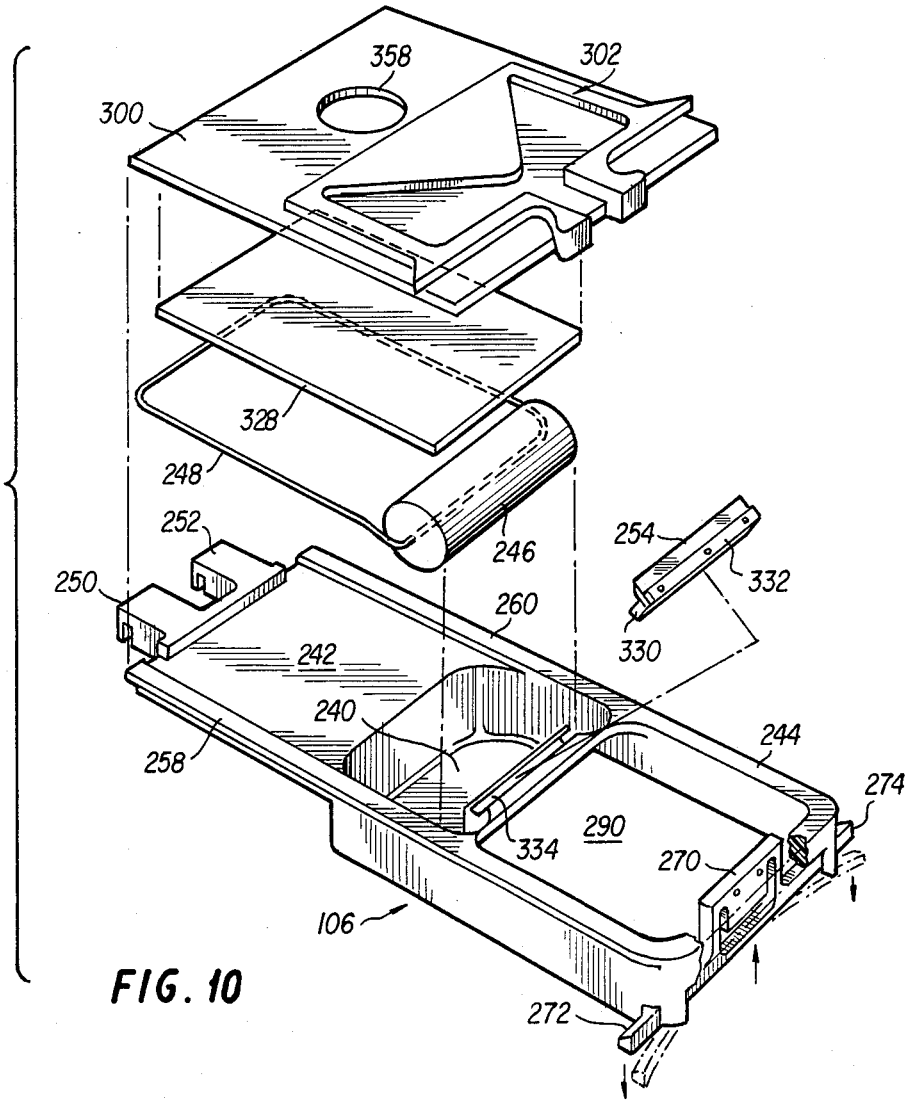
FIG. 10 is an exploded view illustrating the details of the ink reservoir and the relative positions of the printing plate, plate holder, and ink reservoir when the pad mechanism is in the home position.

FIG. 10 is an exploded view illustrating the relative positions of the ink reservoir 106, plate holder 300, and printing plate 328 when the plate carriage 104 is in the retracted position. This view also illustrates the manner in which the inking roller 246 and doctor blade 254 are removable from the body of the ink reservoir 106 for cleaning or replacement. The inking roller 246 and wire form 248 are removed as a unit, as shown. The doctor blade support consists of an elongated lower block 330 and an upper strip 332, between which the doctor blade 254 is held. The body of the ink reservoir 106 is formed with a rectangular cavity 334 which is shaped and dimensioned to receive the block 330 and thereby hold a doctor blade 254 in the proper position. The forward part of the ink reservoir handle 244 has been cut away in FIG. 10 to illustrate the operation of the plastic latch device 270 which locks the ink reservoir in the reservoir holder 108. As the reservoir 106 is being inserted, the horizontally projecting tabs 272, 274 are deflected downwardly, as shown, by contact with the beveled surfaces 335, 336 (visible in FIG. 9) on the forward ends of the arms 266, 268 of the reservoir holder 108. When the reservoir 106 reaches the proper position within the holder 108, the tabs 272, 274 snap upward into a pair of downwardly facing notches 276, 278 (visible in FIG. 8) formed near the forward ends of the reservoir holder arms 266, 268. When it is desired to remove the ink reservoir 106 from the holder 108, the latch 270 is pushed upwardly to cause the projecting tabs 272, 274 to move downwardly and thus disengage from the notches 276, 278.

Figure 11:
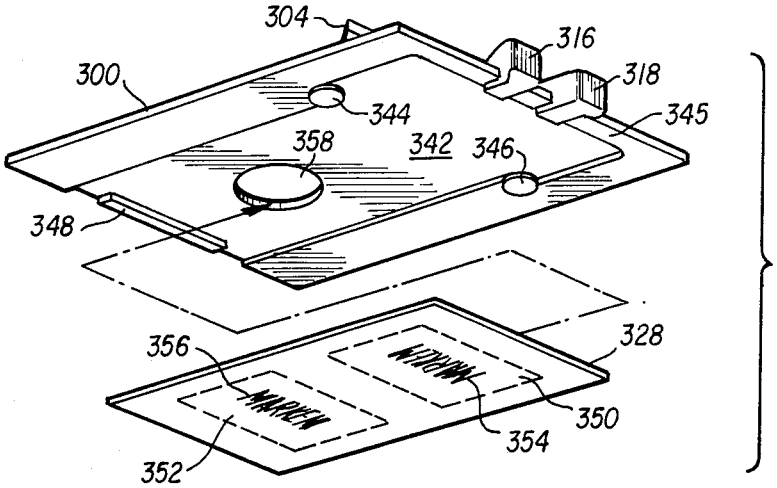
FIG. 11 is an exploded view illustrating the manner in which the engraved printing plate is removably received in the plate holder.

FIG. 11 illustrates the underside of the plate holder 300, to which the printing plate 328 is attached. The underside of the plate holder 300 is formed with a depressed area 342 into which the printing plate 328 fits, and is provided with a pair of disk-shaped fasteners 344, 346 which are spaced slightly away from the depressed surface 342. The printing plate 328 is slid into the plate holder 300 in the direction shown and is held in position by virtue of having its edges held between the fasteners 344, 346 and the underside of the plate holder 300 in the depressed area 342. The printing plate 328 is prevented from sliding horizontally by contact with the ridge 345 at the forward edge of the depressed area 342 and by contact with a second ridge 348 which contacts the rear edge of the plate. A finger hole 358 (also visible in FIG. 9) is formed in the plate holder 300 to allow the operator to raise the rear edge of the plate above the ridge 348 when it is desired to remove the printing plate 328 from the plate holder. In the preferred embodiment, the size of the printing plate 328 is sufficient to accommodate two legend areas 350, 352, each containing a separate legend 354, 356. The stroke length of the printing plate carriage 104 is such that only the forward legend area 350 is utilized during the operation of the printing machine 30. When the forward legend area 350 has become worn, the printing plate 328 can be removed and reinstalled in the plate holder 300 with the second legend area 352 occupying the forward position. In this way, the printing plate 328 is used in the most economical fashion and the number of spare printing plates which must be kept on hand is reduced. If desired, the legends 354, 356 may be different and the printing plate 328 may be reversed whenever it is desired to change legends. A preferred type of printing plate 328 consists of an anodized aluminum plate with the legends 354, 356 chemically etched into the anodized layer. However, single-layer printing plates made of steel, plastic or other materials can also be used. Regardless of the material chosen, the legends 354, 356 are etched or engraved into the surface of the plate and, for this reason, the printing plate 328 is referred to as a gravure or intaglio printing plate. As is well known, the gravure or intaglio printing process involves applying ink to the printing plate and then scraping the plate so that the ink remains only in the grooves or depressions which form the legend to be printed. The ink remaining in the legend areas is then transferred to the surface to be printed, either by direct contact or by means of an intermediate transfer member. In the present invention, the resilient transfer pad 45 functions as a transfer or offset member for lifting the inked images from the printing plate 328 and transferring them to the surface to be printed.

Figure 12:
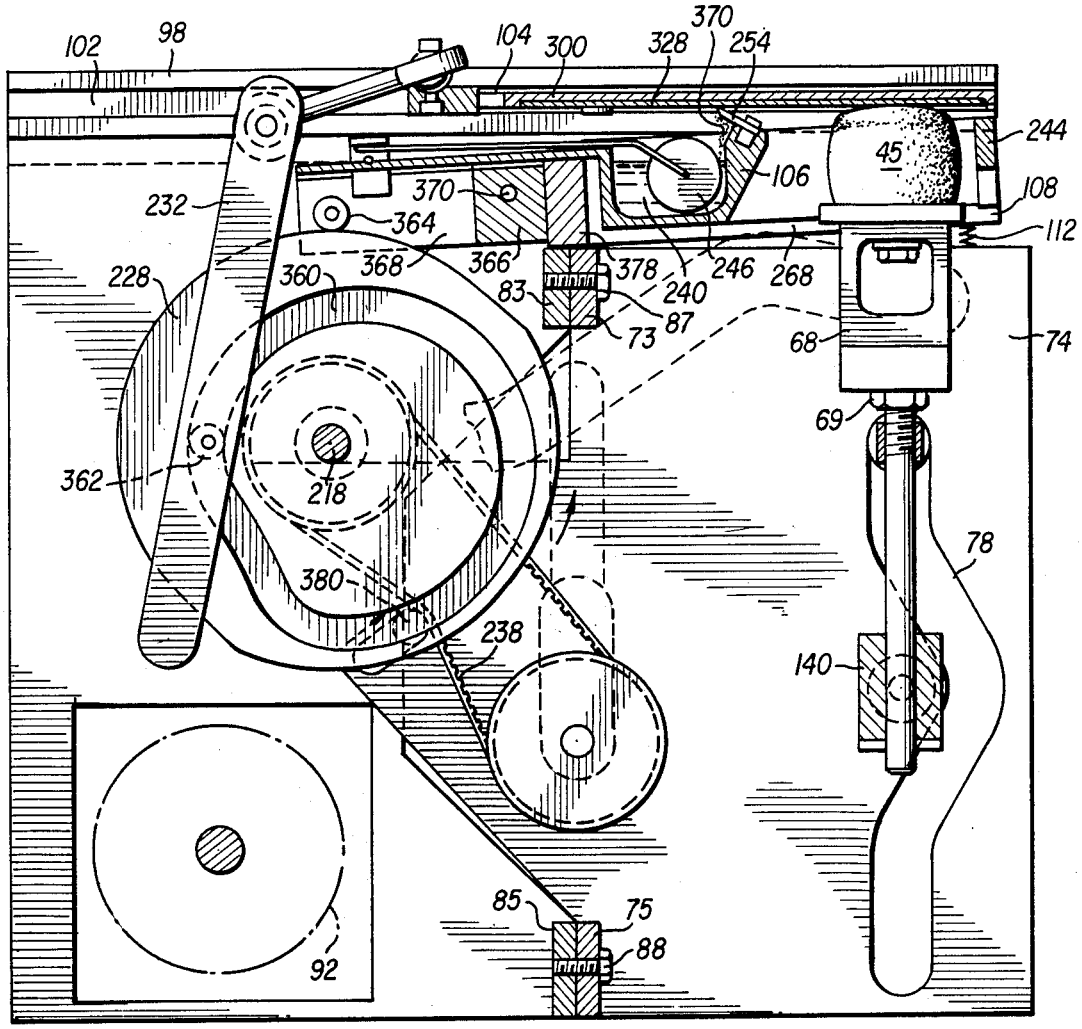
FIG. 12 is a sectional view illustrating the pad mechanism in its fully raised position and the printing plate in its operative or pad contacting position.
Figure 15:
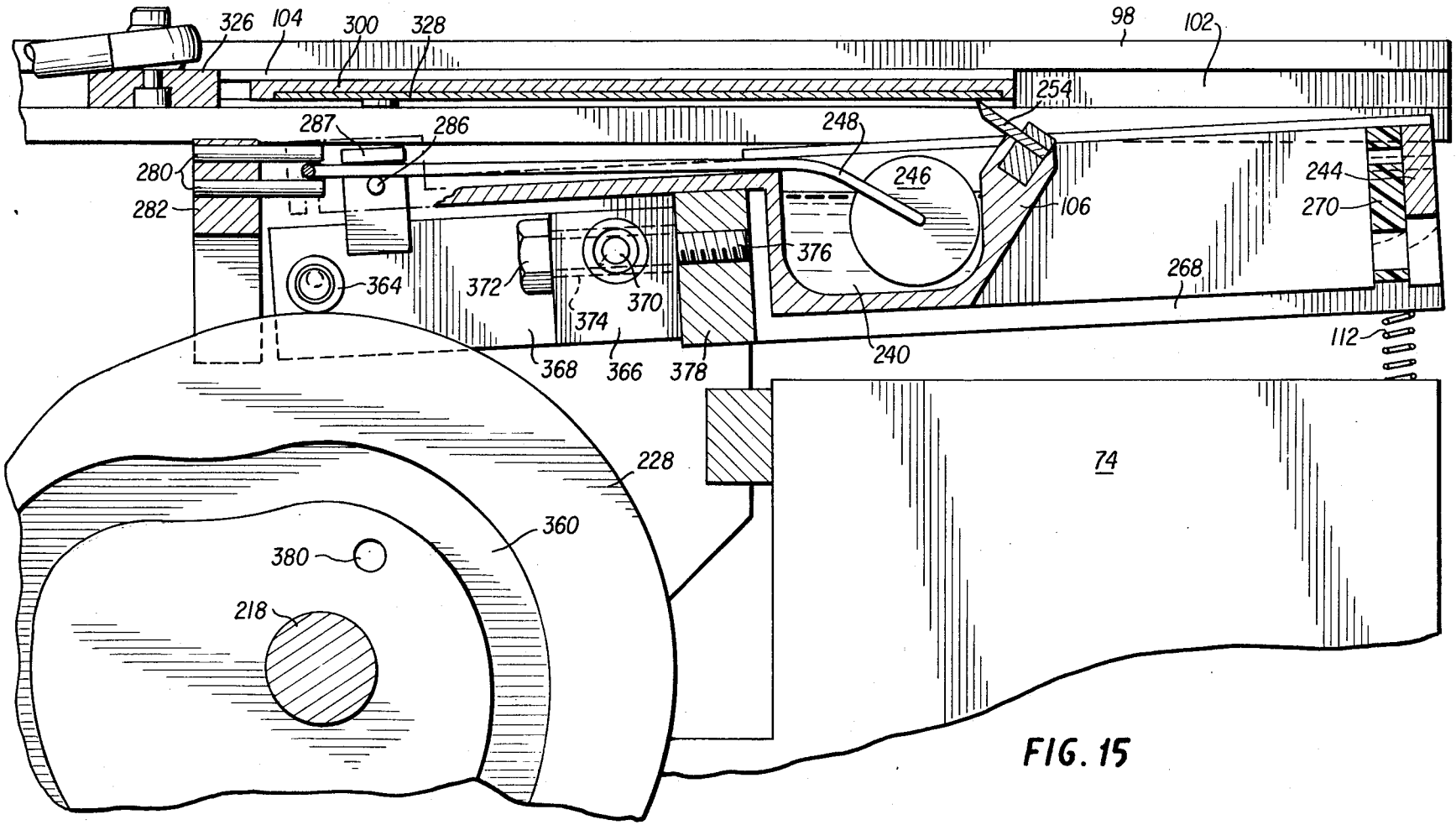
FIG. 15 is an enlarged sectional view similar to FIG. 14, illustrating the positions of the ink reservoir and the printing plate when the pad mechanism has reached the hole position.

FIG. 12 is a sectional view illustrating the relative positions of the transfer pad 45, ink reservoir 106 and printing plate 328 at the point during the printing cycle when the inked image is transferred from the printing plate to the transfer pad. Also illustrated in FIG. 15 is the cam 228 which controls the movements of the plate holder 104 and ink reservoir 106. The cam 228 is formed with two cam surfaces, one on the peripheral or external surface of the cam and the other in the form of a groove or channel 360 formed in one face of the cam. The vertical drive arm 232 is provided with a follower 362 at an intermediate point along its length, and this follower rides in the cam groove 360, causing the follower to undergo a back-and-forth reciprocating movement as the cam rotates. The lower end of the drive arm 232 is pivotally supported by a shaft 234, as illustrated previously in FIG. 7. With the drive arm 232 mounted in this fashion, the back-and-forth reciprocating motion of the cam follower 362 causes the drive arm 232 to execute a similar motion, thereby sliding the printing plate carriage 104 forward and backward between its operative and retracted positions as described previously. A second cam follower 364 is held in contact with the peripheral surface of the cam 228 and functions to impart vertical rocking movement to the ink reservoir 106. The ink reservoir 106 is carried by the reservoir holder 108, as previously described, and the reservoir holder 108 is in turn affixed to a pivotally mounted cross-member 366 which extends between the side walls 82, 84 of the outer frame 80. Referring for a moment to FIG. 8, in which the pivotable cross-member 366 can be seen behind the rear part 378 of the reservoir holder 108, it will also be seen that a bracket 368 extends rearwardly from the pivotable member 366 to support the movable drive member 288. The drive member 288 supports the wire form 248 of the ink reservoir by means of the pins 284, 286 and upper retainers 285, 287. The cam follower 364 is rotatably connected to the rear part of the bracket 368 as shown in FIG. 12. As a result of this arrangement, the reservoir holder 108, and hence the ink reservoir 106, will pivot about the axis 370 of the member 366 under the control of the cam 228. It will be observed from FIG. 12 that the trough portion 240 of the ink reservoir 106, which carries the inking roller 246 and doctor blade 254, is located on the opposite side of the pivot axis 370 from the cam follower 364. Therefore, when the external profile of the cam 228 rises and causes the bracket 368 to move upwardly, the trough 240 of the ink reservoir moves downwardly, and vice-versa. This motion of the ink reservoir 106 is used to move the doctor blade 254 into and out of contact with the downwardly facing surface of the printing plate 328 at the proper times during the printing cycle. The reservoir holder 108 is normally biased in an upward position by the coil springs 110, 112, which are disposed between the reservoir holder and the vertical plates 72, 74 of the inner frame. These springs serve to hold the doctor blade 254 in contact with the printing plate 328 and also to maintain the cam follower 364 in contact with the peripheral surface of the cam 228. When the high points on the external part of the cam 228 are aligned with the follower 364, the bracket 368 is pivoted upwardly and the reservoir holder 108 is pivoted downwardly against the compressive force of the springs 110, 112. When this occurs, the trough portion 240 of the ink reservoir is forced downwardly and the doctor blade is separated from the printing plate 328. The angular relationship between the profile of the inner cam groove 360 and the outer cam profile is such that the vertical movement of the doctor blade 254 into and out of contact with the printing plate 328 occurs only at certain selected positions of the plate carriage 104. The motion of the transfer pad 45 is also synchronized to the movement of cam 228 by virtue of the timing belt 238 which connects the cam shaft 218 to the pad linkage. A belt tensioner 380, mounted on the inside surface of the outer frame wall 82, is provided to maintain tension in the timing belt 238 and can be loosened when it is desired to remove the belt from the pulleys 230, 236. The positions of the various components of the printing machine 30 at various points during a complete cycle of operation will be described in more detail below in connection with FIGS. 19–26.

In FIG. 12, the rotational position of the cam 228 in such that the plate carriage 104 has moved fully forward to its operative or pad contacting position, and the forward portion of the ink reservoir 106 is raised so that the doctor blade 254 is in contact with the printing plate 328. In this position, the doctor blade 254 has served to remove the excess ink from the downwardly facing surface of the printing plate 328 during the forward motion of the plate, and has returned the ink so removed to the trough 240 of the reservoir by gravity. For illustrative purposes, a quantity of ink 370 is shown returning to the trough 240 along the rear edge of the doctor blade 254. It should be noted from FIG. 12 that the doctor blade 254 is held at an acute angle relative to the surface of the printing plate 328 as the latter moves towards the operative position; that is, the leading edge of the doctor blade 254 faces in the direction opposite to the direction of plate movement. This may be described as reverse-angle doctoring, since it is opposite to the usual arrangement, used with upwardly facing printing plates, in which the doctor blade is held at a trailing angle relative to the printing plate. The reverse angle doctor blade 254 effectively peels or shaves the layer of ink from the surface of the printing plate 328 and insures that the ink flows directly downward into the reservoir trough 240. By contrast, trailing-angle doctor blades operate by pushing or "plowing" the layer of ink and tend to cause an outward migration of the ink toward the lateral edges of the blade. This can result in stripes or bands of ink being left along the lateral edges of the printing plate by the scraper blade. This condition would be highly undesirable in the present apparatus since the printing plate 328 is held in a face-down position, and, as a result, any ink accumulations not removed by the doctor blade could drip downwardly and contaminate other components of the printing machine. This problem is avoided by the use of the reverse angle doctor blade 254 in the present invention.

In FIG. 12, the inking roller 246 occupies a lowered position within the trough 240 of the ink reservoir 106, and is therefore not in contact with the surface of the printing plate 328. The wire form 248 which supports the inking roll 246 is mounted in a manner such that, whenever the forward portion of the ink reservoir 106 is tipped upward to bring the doctor blade 254 into contact with the printing plate 328, the inking roll 246 is lowered out of contact with the printing plate; and, conversely, whenever the forward portion of the ink reservoir 106 is lowered to separate the doctor blade 254 from the printing plate 328, the inking roll 246 is raised and brought into contact with the printing plate. The precise manner in which this inverse movement of the inking roller 246 and doctor blade 254 occurs will be explained shortly in connection with FIGS. 14 and 15. In general, the purpose of this arrangement is to insure that the printing plate 328 is inked and scraped during opposite strokes of the printing plate carriage 104. When the printing plate carriage moves from the retracted position to the operative or pad contacting position, as would occur just prior to the cycle position represented in FIG. 12, the doctor blade 254 is in contact with the printing plate 328 and the inking roller 246 is retracted. During this interval, the doctor blade 254 removes excess ink that was applied to the printing plate 328 during the previous cycle. Shortly after the cycle position shown in FIG. 12, the forward portion of the ink reservoir 106 is lowered in order to separate the doctor blade 254 from the printing plate 328 and, simultaneously, the inking roller 246 is raised into contact with the printing plate. This reversal occurs shortly after the plate carriage 104 begins to move in the reverse direction, so that ink is applied to the printing plate 328 by the inking roller 246 as the plate moves toward the retracted position. This sequence of operations is repeated during each printing cycle, with the inking roller 246 applying ink to the printing plate 328 as the plate moves from the operative position to the retracted position, and with the excess ink being removed by the doctor blade 254 as the plate moves from the retracted position back to the operative position.

Figure 13:
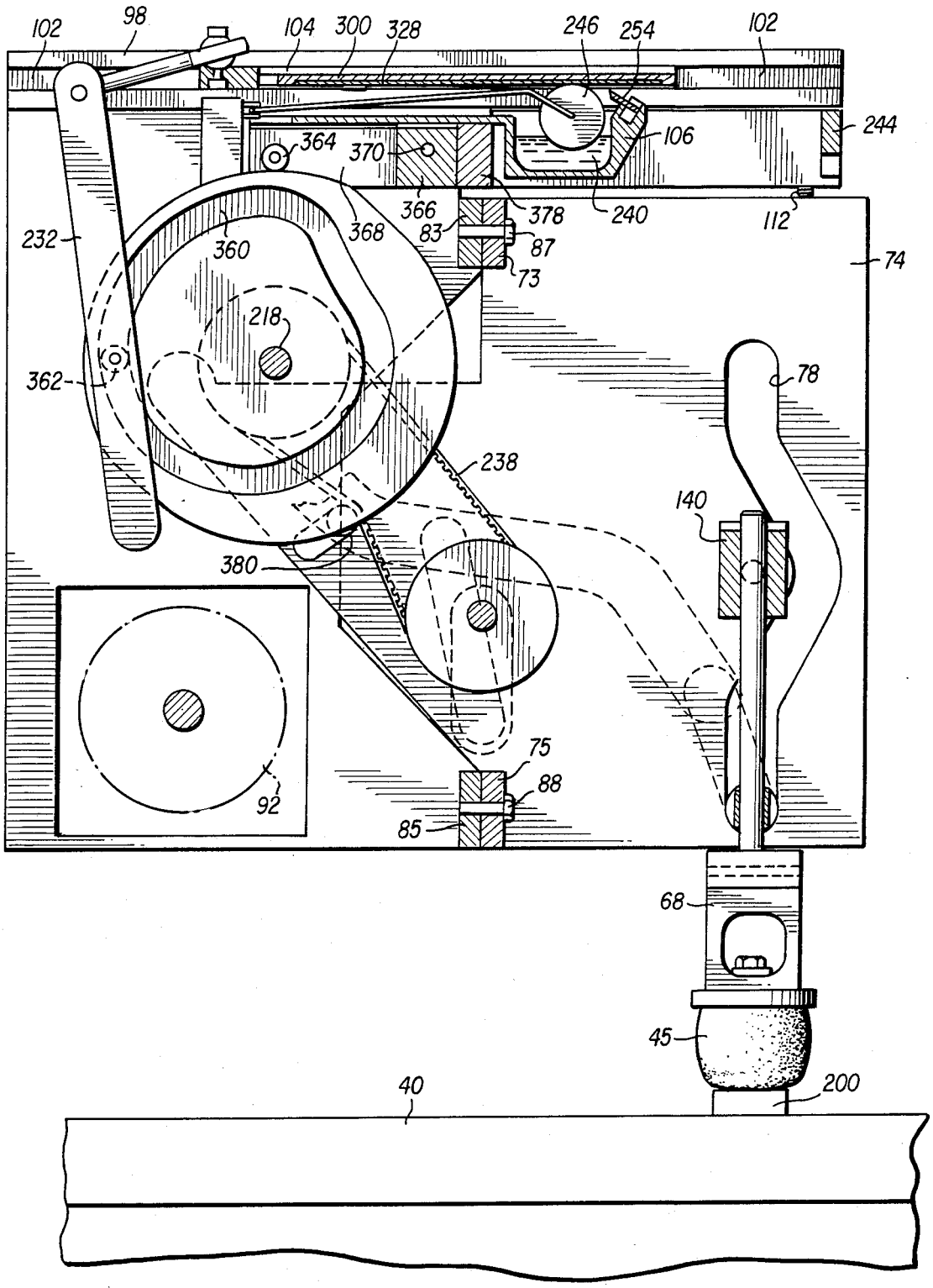
FIG. 13 is a sectional view similar to FIG. 12, with the pad mechanism shown in its fully lowered position and the transfer pad in contact with an article to be printed.

In FIG. 13, the pad mechanism is shown in the fully downward position with the resilient transfer pad 45 in printing contact with the article 200. The cam 228 has now rotated to a position at which the drive arm 232 has moved leftward, and, as a result, the plate carriage 104 has been displaced to a position near its fully retracted position. The cam follower 364 is now in contact with the portion of the cam periphery which has the greatest radius, thereby causing the bracket 368 to move upwardly and the forward portion of the ink reservoir 106 to pivot downwardly against the restoring force of the springs 110, 112. The legend area of the printing plate 328 has been flooded with ink by the inking roller 246, which is still in contact with the plate in FIG. 13. The doctor blade 254, however, is separated from the printing plate as a result of the lowering of the forward portion of the ink reservoir 106. Shortly after the cycle position represented in FIG. 13, the cam 228 causes the forward portion of the ink reservoir 106 to tilt upwardly in order to bring the doctor blade 254 into contact with the printing plate, and, simultaneously, the inking roller 246 is lowered out of contact with the printing plate. This prepares the apparatus for the subsequent forward movement of the plate carriage 104 toward the operative position, during which the doctor blade 254 removes excess ink from the surface of the printing plate. When this motion is completed, ink remains only in the grooves or depressions which define the legend areas of the plate. The inked image is picked up by the resilient transfer pad 45 when the pad arrives at the uppermost position as illustrated in FIG. 12.

Figure 14:
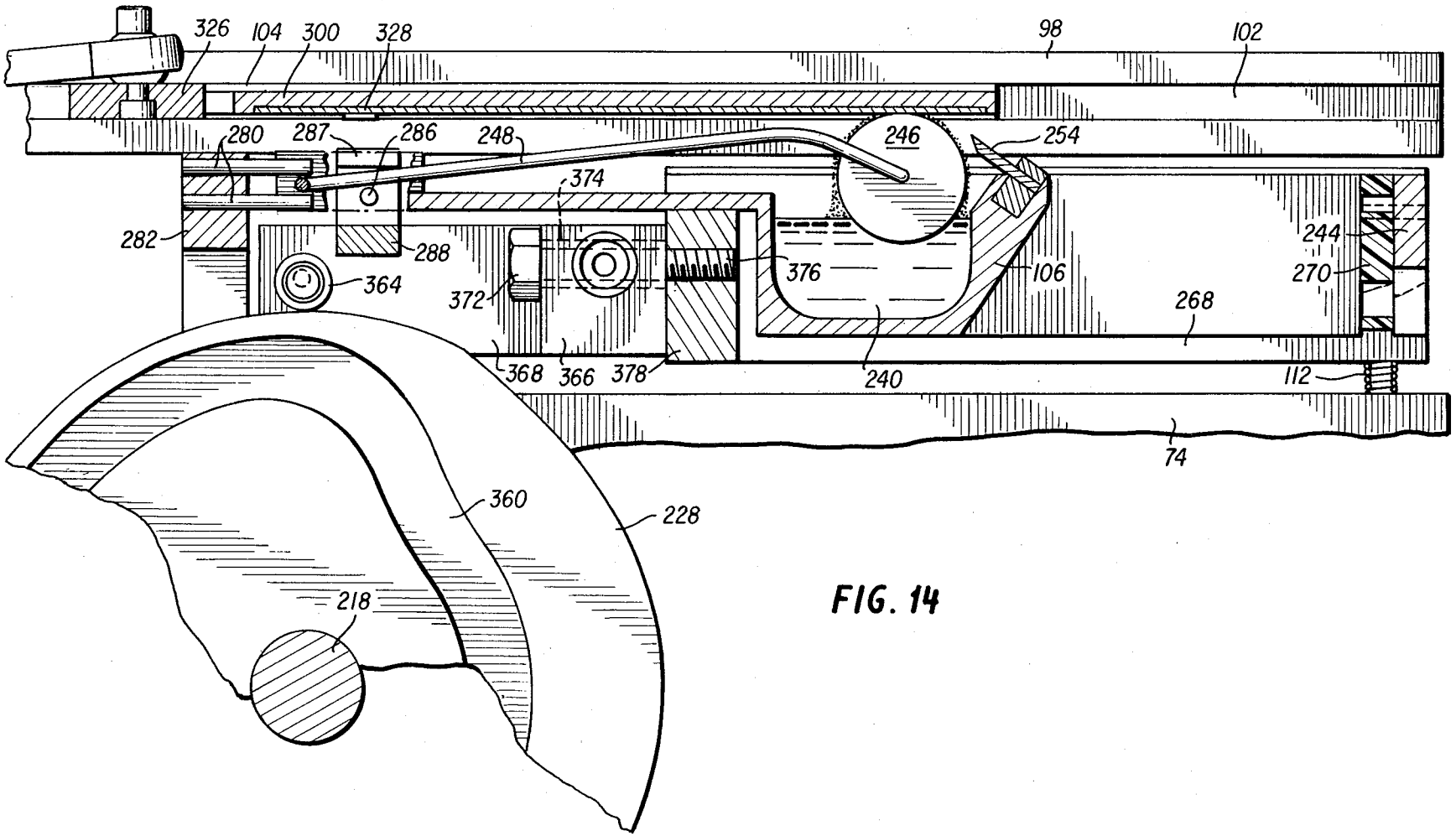
FIG. 14 is an enlarged sectional view illustrating the positions of the ink reservoir and printing plate when the pad mechanism is approaching the home position.

FIGS. 14 and 15 are detailed sectional views illustrating the pivoting or rocking movement of the ink reservoir 106 and the inverse movement of the inking roller 246. In FIG. 14, the plate carriage 104 is at the fully retracted position and the cam 228 has moved the follower 364 and the bracket 368 upwardly. This movement causes the ink reservoir 106 to pivot in a clockwise direction about the pivot axis 370, thereby causing the forward portion of the ink reservoir 106 to move downwardly and the doctor blade 254 to separate from the printing plate 328 as shown. The same motion causes the inking roller 246 to move upwardly into contact with the printing plate 328 as a result of the mounting of the wire form 248. As previously described in connection with FIGS. 8 and 9, the rear part of the wire form 248 is captured between a pair of horizontal pins 280 which are carried by a stationary member 282. The side portions of the wire form 248 are captured between the facing pins 284, 286 and upper retainers 285, 287 which are carried by a U-shaped member 288. The member 288 is affixed to the bracket 368 on which the cam follower 364 is mounted, and will therefore be moved upwardly by the bracket 368 under the control of the cam 228. With the rear portion of the wire form 248 held in a fixed vertical position by the pins 280, and the side portions of the wire form displaced upwardly by the pins 284, 286, it is apparent that the upward movement of the bracket 368 will cause the wire form 248 as a whole to pivot in a counter-clockwise direction in FIG. 14. This motion causes the forward end of the wire form to move upward, bringing the inking roller 246 into contact with the printing plate 328. As previously noted, this motion is accompanied by a simultaneous downward movement of the forward portion of the inking reservoir 106, which separates the doctor blade 254 from the surface of the printing plate 328. FIG. 15 illustrates the reverse situation, in which the doctor blade 254 is in contact with the printing plate 328 and the inking roller 246 is in its lower retracted position. This condition results from the fact that the follower 364 is at a point of reduced radius on the periphery of the cam 228, causing the bracket 368 to move downwardly and the reservoir holder 108 to move upwardly under the influence of the springs 110, 112. This corresponds to a counter-clockwise pivoting motion of the entire reservoir apparatus about the axis 370 of the pivot member 366. This results in an upward movement of the forward portion of the ink reservoir 106, causing the doctor blade 254 to contact the printing plate 328. Simultaneously, however, the side portions of the wire form 248 are shifted downwardly due to the downward movement of the bracket 368, support member 288, and pins 284, 286 and retainers 285, 287. With the rear portion of the wire form 248 held in a fixed vertical position by the retaining pins 280, and the side portions of the wire form being forced downwardly, the wire form 248 as a whole is pivoted in a clockwise direction. This causes the inking roller 246 to move downwardly and out of contact with the printing plate 328 as illustrated in FIG. 15. The application of a positive downward force to the wire form 248, as distinguished from simply allowing the wire form 248 and inking roller 246 to drop by gravity, is advantageous because it insures that the inking roller will separate from the printing plate 328 even when the viscosity of the ink would otherwise be sufficient to cause the roller to adhere to the plate.

In the home position of the printing machine 30, referred to earlier, the plate carriage 104 and ink reservoir 106 are in the positions shown in FIG. 15. When it is desired to remove the printing plate 328 from the printing machine for cleaning or legend changes, this is done while the machine is stopped in the home position. Referring for a moment to FIG. 9, removal of the printing plate is accomplished by disengaging the latch 302 and sliding the plate holder 300 out of the plate carriage 104. As can be appreciated from FIG. 15, the doctor blade 254 is in contact with the printing plate 328 at the home position, and will therefore automatically remove excess ink from the plate as the plate is removed. The plate is removed by sliding the plate holder 300 in the right-hand direction in FIG. 15, which is also the direction in which the plate carriage 104 moves when the plate is being scraped during the normal operation of the printing machine. The excess ink removed from the printing plate 328 by the doctor blade 254 during removal of the plate is returned to the trough 240 of the ink reservoir, in exactly the same manner as ink is removed from the plate during the forward stroke of the plate carriage 104 from the retracted position to the operative position. The automatic scraping feature is an important aspect of the present invention, since it allows the printing plate 328 to be removed in a relatively clean and ink-free condition. It is not necessary for the operator to handle the plate in a flooded condition, and, as a result, the plate change operation can be performed quickly and conveniently. Moreover, since the ink that is scraped from the plate is automatically returned to the ink reservoir 106 as the plate is removed, little or no ink is wasted. It will be appreciated from FIG. 15 that the printing plate 328, prior to its removal, is flooded with ink which was applied to it by the printing roller 246 during the previous movement of the plate carriage 104 from the operative position to the retracted position. Due to the flooded condition of the plate, the ink will not dry in the engraved areas of the plate if the machine is left in the home position for an extended period of time without removing the plate.

It may be observed that the upward and downward reciprocation of the inking roller 246, as illustrated in FIGS. 14 and 15, is not strictly necessary. In order to simplify the apparatus, the wire form 248 may be supported permanently in the position shown in FIG. 14 so that the inking roller 246 remains in constant contact with the printing plate 328. This will result in the printing plate being inked twice during each printing cycle, once during the forward movement of the plate holder 104 and once again during the reverse movement of the plate holder. Although the additional inking step is not itself undesirable, as long as the doctor blade 254 is located ahead of the inking roller 246 as shown, there are at least two problems with this arrangement that render it less desirable than the illustrated embodiment. First, with the inking roller 246 held continually in an elevated position, a newly inserted printing plate will be flooded with ink along its entire length. The ink will cover the unused rear legend portion 352 of the plate and the rear edge of the plate holder 300. The ink applied to these areas can be difficult to clean off, particularly if allowed to dry, and can also contaminate the adjacent areas of the printing machine, such as the rear inside portion of the plate carriage 104. A second problem is that the ink roller 246, if held in continuous contact with the printing plate 328, will be required to reverse its direction of rotation after applying ink to the the plate during forward movement and scraping of the plate. This would occur, for example, at the position of the plate carriage shown in FIG. 12. After this reversal, the depleted side of the roller, from which ink has just been taken, is once again brought into contact with the printing plate. This can result in uneven inking of the printing plate in the legend area, with a consequent degradation of the print quality. Both of the foregoing problems are avoided by reciprocating the inking roller 246 between the elevated and retracted positions, as described earlier.

With continued reference to FIGS. 14 and 15, the reservoir holder 108 is affixed to the pivot member 366 by means of a shoulder bolt 372. A bushing 374 within the pivot member 366 receives the shank of the shoulder bolt 372, and the threaded portion 376 of the bolt engages a tapped hole in the center of the rear section 378 of the ink reservoir holder 108 (see also FIG. 8). By virtue of the bushing 374, the reservoir holder 108 and shoulder bolt 372 can pivot to some extent relative to the member 366, such pivoting occurring about a horizontal axis which is coincident with the axis of the bolt 372 and perpendicular to the pivot axis 370 of the member 366. This pivoting motion is advantageous when combined with the individual upward biasing effect of the springs 110, 112 at the forward ends of the reservoir holder 108, as will now be described in connection with FIG. 16. In this view, which illustrates the forward ends of the reservoir holder arms 266, 268, the phantom position of the printing plate 328 is not perfectly horizontal but instead is inclined in a side-to-side direction. This may occur as a result of machine tolerances, unevenness in the plate thickness, and other factors contributing to a relative lack of parallelism between the printing plate and the doctor blade 254. The amount of inclination would usually be quite small in actual practice, but even a small misalignment between the doctor blade 254 and the surface of the printing plate 328 can be enough to cause improper scraping of the printing plate. In the illustrated apparatus, this result is avoided by virtue of the fact that the right and left-hand arms 266, 268 of the reservoir holder 108 are supported and biased upwardly by separate coil springs 110, 112. When there is a misalignment condition, as indicated in phantom outlines, the springs 110, 112 urge the arms 266, 268 upwardly by the different amounts necessary to cause the doctor blade 254 to align itself with the surface of the printing plate. The ability of the reservoir holder 108 to pivot about the axis of the shoulder bolt 372 allows the arms 266, 268 to move in the manner required. In addition to compensating for a misaligned printing plate 328, the foregoing arrangement can compensate for misalignments of the doctor blade 254 itself, or of the ink reservoir 106. Moreover, apart from the problem of alignment, the springs 110, 112 also facilitate the adjustment of the reservoir holder 108 to accommodate printing plates with different thicknesses. As illustrated in FIGS. 14 and 15, the cam follower 364 is eccentrically mounted on the bracket 368 to permit a limited degree of vertical adjustment. When a printing plate having a different thickness is used, the follower 364 is adjusted upward or downward to set the proper gap between the doctor blade and the printing plate in the non-scraping position. The springs 110, 112 automatically insure proper contact between doctor blade and the plate surface in the scraping position.

Figure 16:
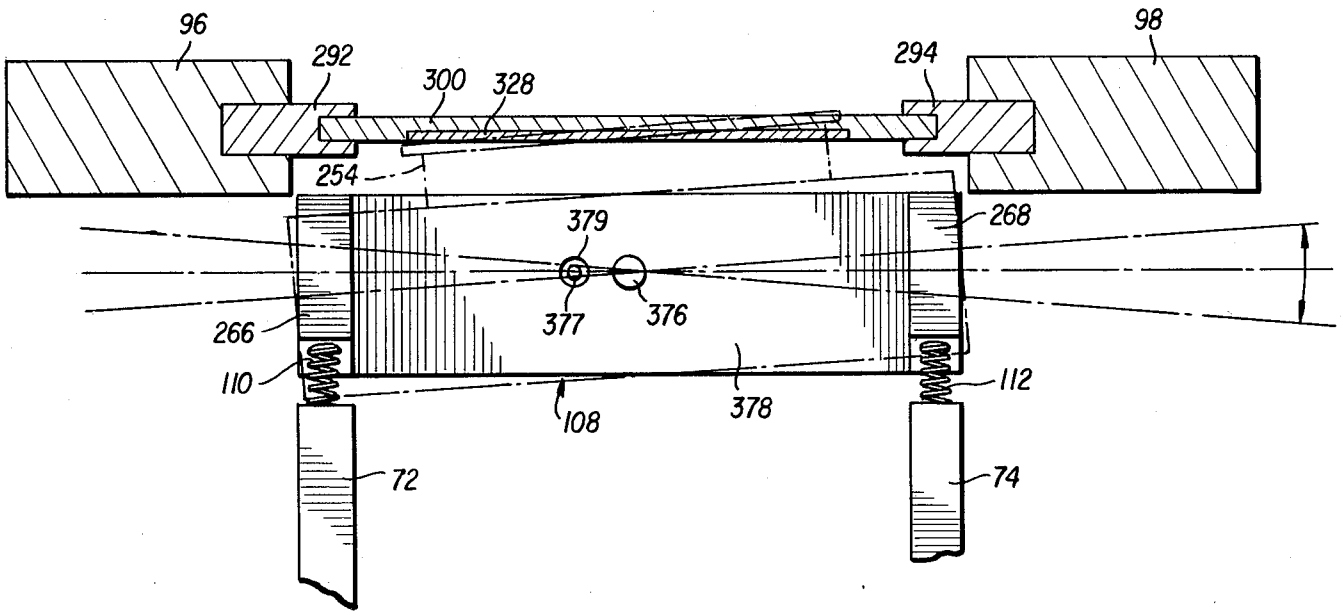
FIG. 16 is a schematic representation of the self-alignment function of the doctor blade carried by the ink reservoir.

With further reference to FIG. 16, a pin 377 is affixed to the member 366 and extends forwardly into a somewhat larger hole 379 formed in the rear part 378 of the reservoir holder. The pin 377 strikes the bottom and top surfaces of the hole 379 to limit the degree of pivoting of the reservoir holder in the clockwise and counterclockwise directions.

Figure 18:
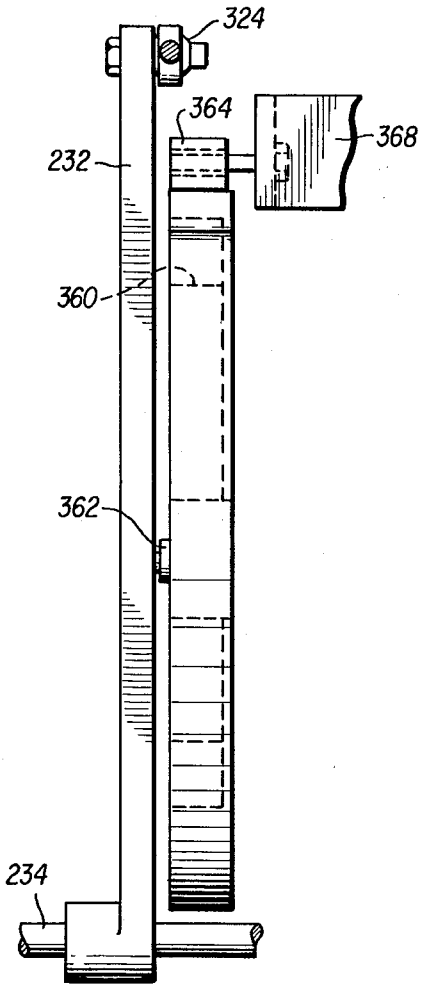
FIG. 18 is an edge-on view of the cam shown in FIG. 17, also illustrating the follower devices used to actuate the printing plate and ink reservoir.
Figure 17:
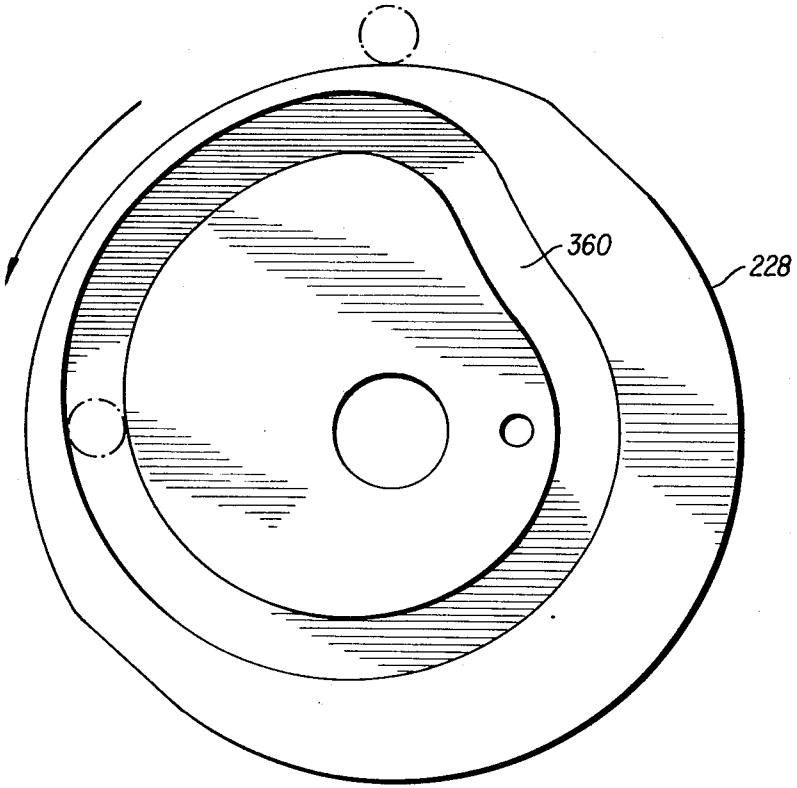
FIG. 17 is a left side view of the cam which controls the movement of the printing plate and ink reservoir.

FIGS. 17 and 18 illustrate in detail the cam 228 which is used to control the motions of the plate carriage 104 and ink reservoir 106. FIG. 17 illustrates the profile of the external surface of the cam and the profile of the interal cam groove, while FIG. 18 illustrates the positions of the follower structures which are connected to the plate carriage 104 and reservoir holder 108. Referring first to FIG. 17, the following table describes the external profile of the cam 228:

TABLE 1

| External Cam Profile | |
|---|---|
| Cam Motion | Action |
| 175° Dwell | Inking |
| 20° Harmonic fall | Blade up, roller down |
| 145° Dwell | Scraping |
| 20° Harmonic rise | Blade down, roller up |

The following table describes the profile of the inner cam groove 360:

TABLE 2

| Internal Cam Profile | |
|---|---|
| Cam Motion | Action |
| 80° Dwell | Pad contact |
| 180° Harmonic Rise | Plate retract |
| 40° Dwell | Home position |
| 60° Harmonic fall | Plate forward |

It will be appreciated from Table 2 that the forward motion of the plate carriage 104 from the retracted position to the operative or pad contacting position is substantially faster than the movement of the plate carrier in the reverse direction. This has to do with the fact that the plate carriage must move the full distance from the retracted position to the operative or pad contacting position, and must then be brought to a standstill, in the relatively short time interval during which the transfer pad moves from the home position to the fully raised position. It will also be noted from Table 2 that the dwell of the plate carriage is longer at the pad contacting position, to allow full compression and release of the transfer pad, than it is at the retracted position.

FIG. 18 illustrates the cam 228 in relation to the follower devices which drive the plate carriage 104 and reservoir holder 108. The plate carriage 104 is reciprocated by a vertical follower arm 232, previously described, which is affixed at its lower end to a rotatably mounted shaft 234. The follower 362 is connected at an intermediate point on the arm 232 and is received in the inner groove or channel 360 of the cam 228 at approximately the 180° position. The reservoir holder 108 is pivoted by a bracket 368, previously described, which carries the eccentrically mounted follower 364. The follower 364 is held in contact with the peripheral surface of the cam 228 at approximately the 90° position as shown.

Figure 19:
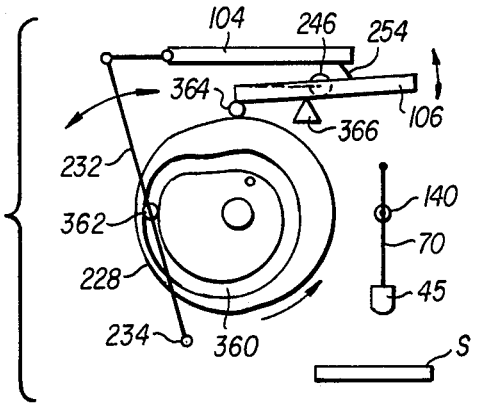
FIGS. 19–26 are diagrammatic sequence views illustrating one complete cycle of operation of the printing machine.
Figure 20:
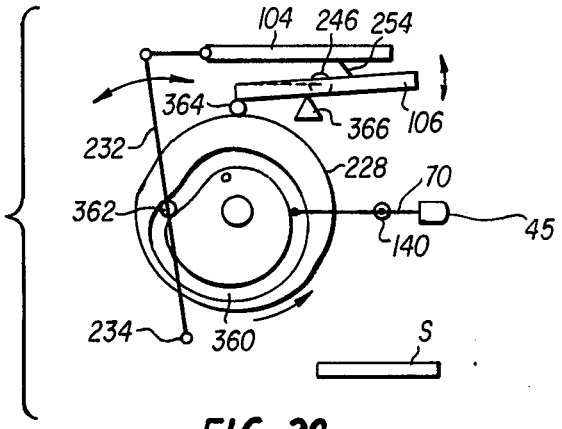
Figure 21:
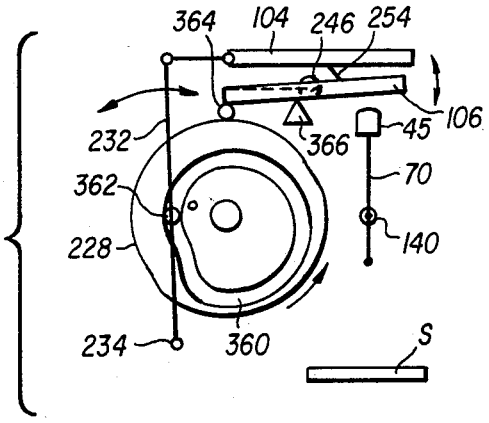
Figure 22:
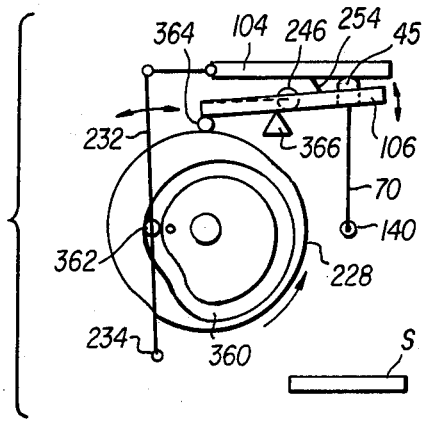
Figure 23:
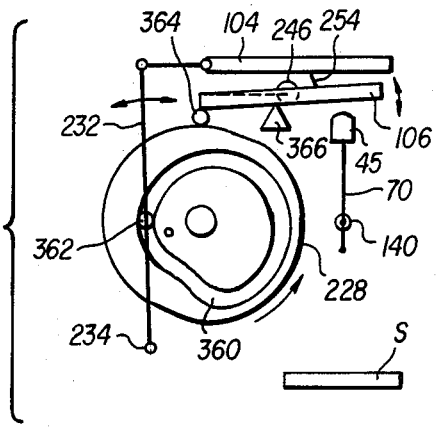
Figure 24:
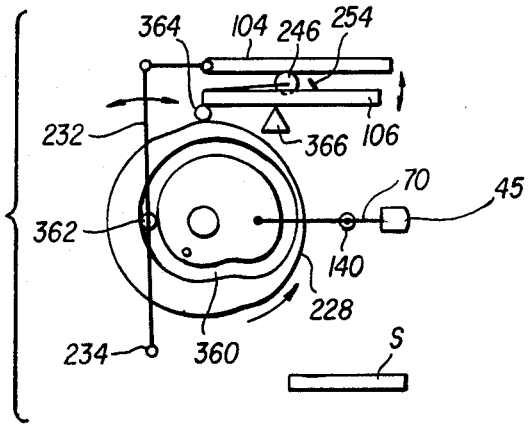
Figure 25:
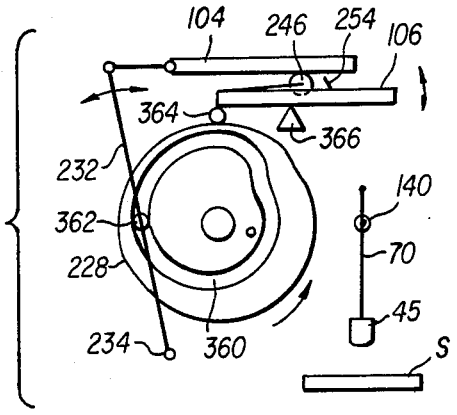
Figure 26:
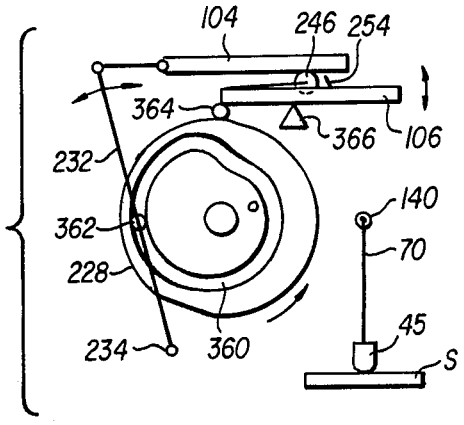

FIGS. 19–26 are diagrammatic illustrations which depict the positions of the principal components of the printing machine 30 at various points during a complete cycle of operation. In FIG. 19, the printing machine is illustrated in the home position, which defines the beginning of the printing cycle. In this position, the resilient transfer pad 45 is elevated somewhat above the surface S to be printed and the plate carriage 104 is in the fully retracted position. The forward portion of the ink reservoir 106 is tilted upwardly to bring the doctor blade 245 into contact with the forward edge of the printing plate, and the inking roller 246 has been lowered so that it is not in contact with the printing plate. The printing plate is flooded with ink which was applied to it by the inking roller 246 during the preceding printing cycle. In FIG. 20, the transfer pad 45 is moving upward and has reached the middle position of its upward stroke. The plate holder 104 has begun to move in the forward direction and the doctor blade 254, which is still in its raised position, is removing excess ink from the printing plate and returning the ink to the reservoir 106. In FIG. 21, the plate carriage 104 has reached the fully foward or operative position. The printing plate is now directly above the transfer pad 45, which has completed its 180° rotation and is now facing vertically upward. The printing plate has been scraped free of excess ink by the doctor blade 254, so that the ink remains only in the legend areas. The doctor blade 254 has not yet been retracted and is still in contact with the downwardly facing surface of the printing plate. In FIG. 22, the transfer pad has moved vertically upward through the handle of the ink reservoir 106 and is pressed into contact with the inked legend area of the printing plate. The doctor blade 254 is still in contact with the printing plate and the ink roller 246 remains in its lowered or retracted position. In FIG. 23, the transfer pad 45 has separated from the printing plate and is moving vertically downward. The upper surface of the transfer pad now carries the inked legend removed from the printing plate. The plate carriage 104 remains stationary at the operative or pad contacting position, and the positions of the doctor blade 254 and ink roller 246 are unchanged. In FIG. 24, the transfer pad is rotating in a clockwise direction and has reached the middle or horizontal position of its downward stroke. The plate carriage 104 has begun to move in the reverse direction toward its retracted position, and the forward portion of the ink reservoir 106 has shifted downwardly to separate the doctor blade 254 from the printing plate. Simultaneous with the lowering of the doctor blade 254, the ink roller 246 is raised into contact with the printing plate and begins to apply ink thereto. In practice, it is preferable to allow the doctor blade 254 to remain in contact with the printing plate for a very short distance (between 1/32 inch and 1/16 inch) as the printing plate begins to move toward the retracted position, as this tends to avoid a build-up of ink on the top edge of the doctor blade. In FIG. 25, the transfer pad 45 has pivoted clockwise by an additional 90° and is now facing vertically downward, in the direction of the surface S as to be printed. The plate carriage 104 is still moving in the reverse direction toward its retracted position, and the inking roller 246 continues to apply ink to the printing plate. The doctor blade 254 remains out of contact with the printing plate. In FIG. 26, the transfer pad 45 has moved vertically downward and is being pressed into contact with the surface S as to be printed in order to transfer the inked image thereto. The plate carriage 104 has reached its retracted position and the printing plate has now been completely inked or flooded by the inking roller 246. The inking roller 246 is still in contact with the printing plate but is about to separate from it, and the doctor blade 254 is about to be brought into contact with the plate. The printing machine then reverts to the home position of FIG. 19, in which the transfer pad 45 has separated from the surface S after transferring the inked legend thereto. The forward portion of the ink reservoir 106 has moved upwardly to bring the doctor blade into contact with the printing plate, and simultaneously, the inking roller 246 has moved downwardly and is no longer in contact with the plate. The home position of FIG. 19 represents the stopped position of the printing machine after a single cycle of operation, when the machine is being operated in an intermittent mode. It likewise represents the stopped position of the printing machine after several successive cycles of operation, when the machine is being operated in a continuous mode. The printing plate is flooded with ink when the machine is in the home position, to avoid drying of the ink in the legend areas of the plate. Removal of the printing plate can be accomplished while the machine is in the home position, and when this is done, the ink on the plate is automatically removed by the doctor blade 254 as described earlier.

Figure 27:
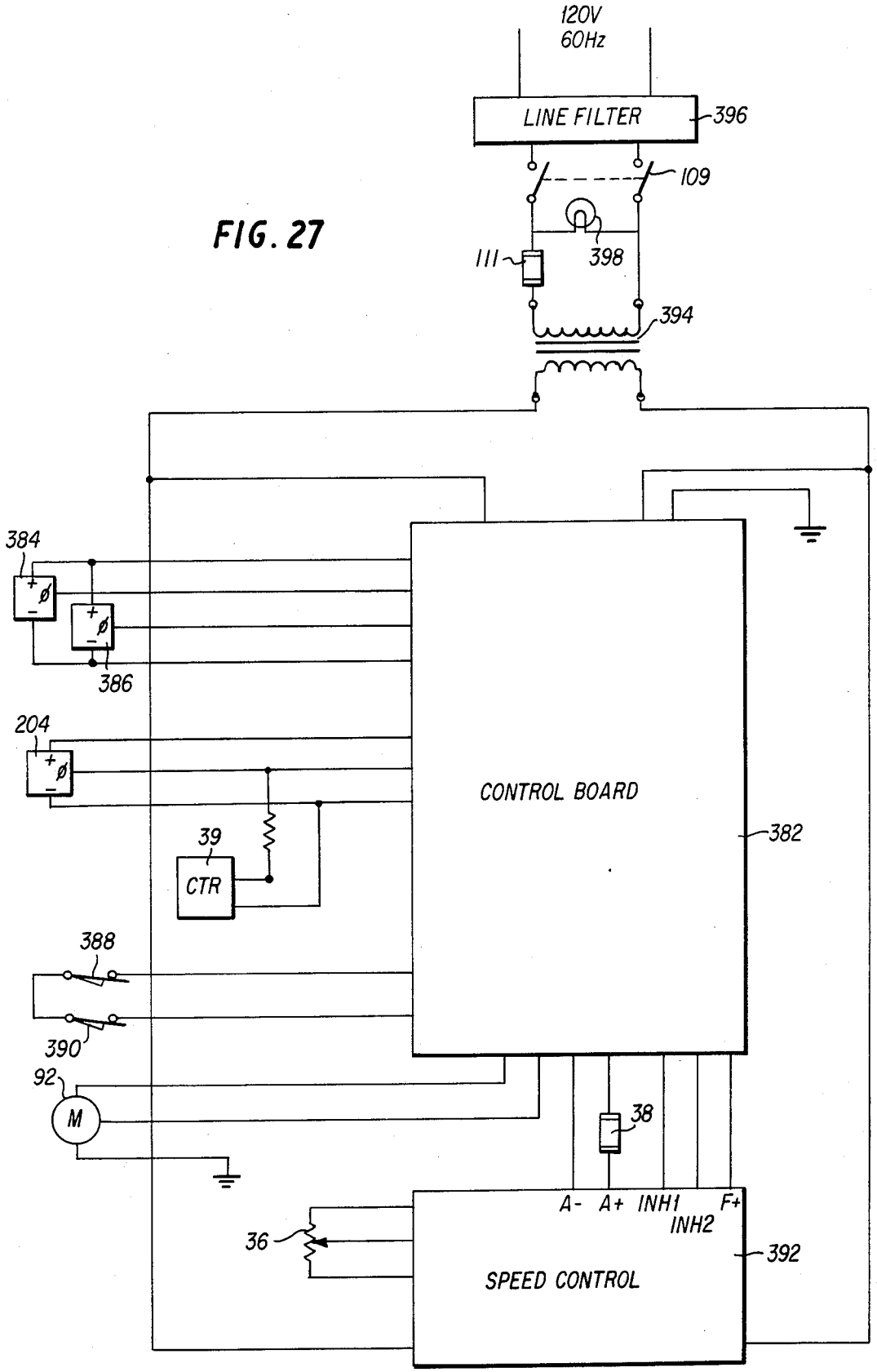
FIG. 27 is a general schematic diagram illustrating the electrical control system of the printing machine.

FIG. 27 is a general schematic diagram of the electrical control system which operates the motor 92 of the printing machine 30. The motor 92 may be controlled either by a single foot switch or by a pair of hand switches, depending upon the setting of a mode switch on a control board 382. The upper switch 384 in FIG. 27 represents either the foot switch or one of the two hand switches, while the lower switch 386 represents the second hand switch. The switches 384, 386 are proximity-type switches, and are shown with three terminals. The home position proximity switch 204 (also shown in FIG. 2) stops the motor at the end of a machine cycle. The motor is dynamically braked in order to provide accurate control of the home stopping position and also to allow for a maximum cycle rate by limiting the motor slowdown time to a minimum. The counter 39 of FIGS. 1–3 is connected in parallel across two terminals of the home position switch 204 in order to keep a running count of the number of completed printing cycles. A pair of magnetic reed switches 388, 390, mounted adjacent to the doors 52, 54 of FIG. 1, are provided as safety interlocks. While the printing machine is running, the opening of either of the switches 388, 390 will cause immediate stopping of the motor 92. The motor will restart when the door is closed and the hand or foot switches 384, 386 are pressed again. The speed control 392 provides a DC voltage of 0 to 130 volts to the permanent magnetic DC motor 92, depending on the setting of the panel-mounted potentiometer 36 (also visible in FIGS. 1–3). The output voltage of the speed control 392 can be forced to 0 by connecting the two inhibit terminals INH1 and INH2. The terminals A− and A+ supply the armature circuit of the motor 92 through the control board 382. The speed control 392 is a commercially available motor control circuit which may be purchased from KB Electronics, Inc. of Brooklyn, N.Y., as Model KBIC-120 (120 VAC input). The armature circuit is provided with a panel-mounted fuse 38, which is also visible in FIGS. 1 and 2. Power for the control board 382 and speed control 392 is provided by a transformer 394 which is connected to the 120-volt power line through a fuse 111, double-pole switch 109, and line filter 396. The fuse 111 and switch 109 are panel-mounted as illustrated in FIG. 3. The switch 109 includes an internal lamp 398 which is illuminated to indicate a power-on condition of the printing machine 30. The transformer 394 may be provided with multiple taps for allowing machine operation from 110-volt, 115-volt, 120-volt, 200-volt, 220-volt, 230-volt, or 240-volt power lines. The line filter 396 reduces transient noise on the power line.

Figure 28:
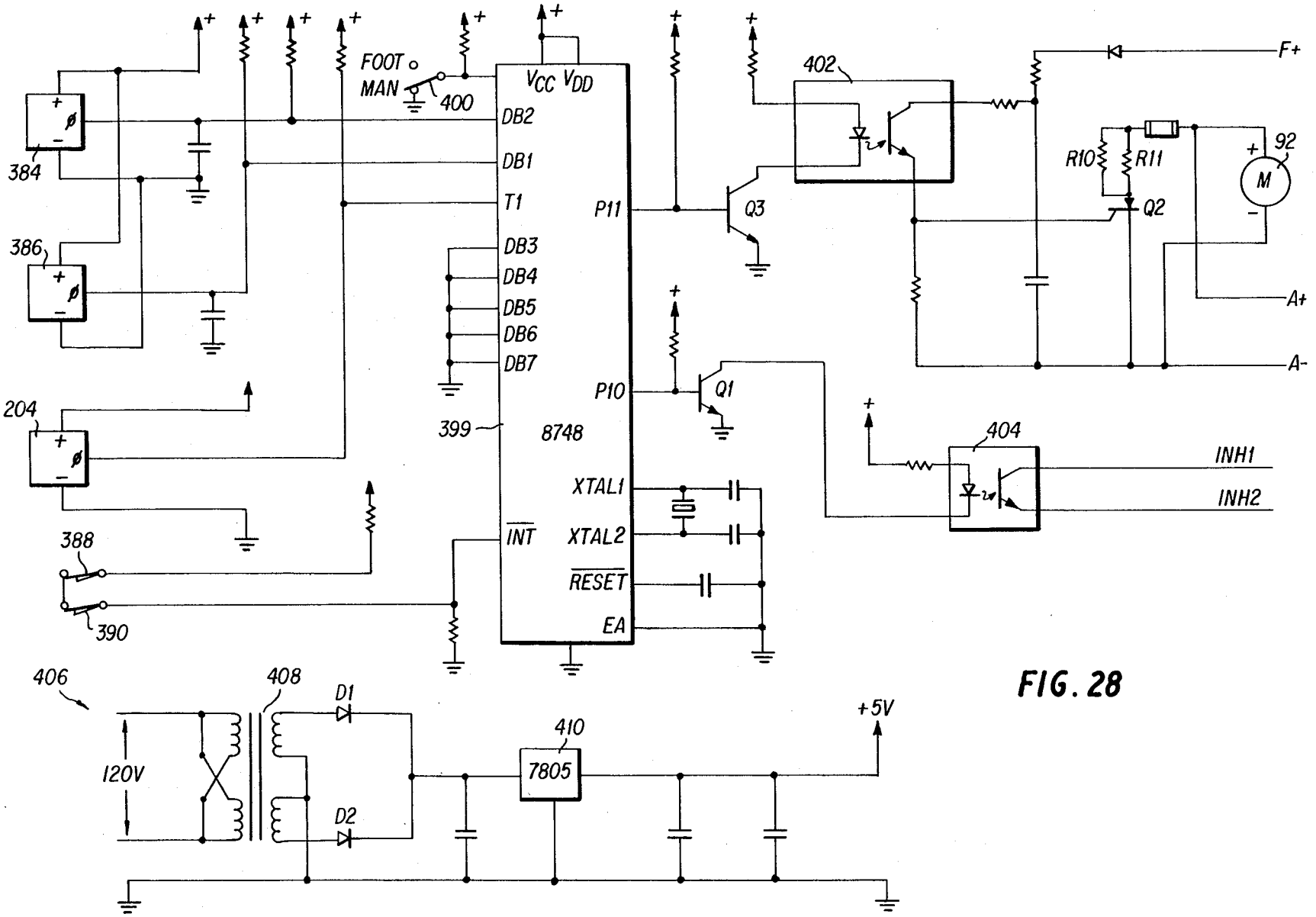
FIG. 28 is a detailed schematic diagram of the microprocessor control board shown in FIG. 27.

FIG. 28 is a detailed schematic diagram of the control board 382. The control board uses an 8748 programmable microprocessor for the control logic. The microprocessor operates in two different modes that are selected by a mode switch 400 on the control board. When the mode switch is in the FOOT position, the motor 92 starts when the single foot switch, corresponding to the switch 384 in FIG. 27, is pressed (i.e., closed). When the foot switch is released, the motor runs until the printing machine reaches its home position as sensed by the proximity switch 204. When the mode switch 400 is in the MAN (manual) position, two hand switches 384, 386 are used in place of the single foot switch. When both hand switches are pressed, the printing machine moves through one complete cycle and then stops at the home position. To start the next cycle, both hand switches must be released and then pressed again. As previously noted, the home switch 204 is a Hall-effect (proximity) type position sensor with a 5-volt output that is connected to the microprocessor. The 5-volt output goes to 0 when the magnet 202 (shown in FIG. 2), which is affixed to the pad linkage, approaches the surface of the sensor. The switches 384, 386 may comprise Hall-effect (proximity) type switches as shown, or conventional mechanical switches. The proximity switches are preferred since they have a longer life. The interlock switches 388, 390 are connected in series to the interrupt input of the microprocessor 399. The opening of either one of the switches 388, 390 will cause the microprocessor to divert from its programmed sequence of operations and immediately initiate the stopping of the motor 92 as indicated previously. The outputs P10, P11 of the microprocessor 399 in FIG. 28 are connected to the motor control circuits through optical isolators 402, 404. When the output P10 of the microprocessor goes low, the output of transistor Q1 goes high, cutting off current flow to the LED in the optical isolator 404. The optical isolator 404 therefore applies a high impedance across the terminals INH1 and INH2 of the speed control 392 of FIG. 27, causing it to provide an output voltage to the motor 92 through the terminals A−, A+. The trigger input to SCR Q2 remains low so that there is no conduction through the power resistors R10 and R11. When the P10 output of the microprocessor 399 goes high to stop the motor, the optical isolator 404 applies a low impedance across the terminals INH1 and INH2 of the speed control, cutting off the output voltage applied to the motor through the terminals A+, A−. At the same time, the microprocessor output P11 goes high to render transistor Q3 conducting, thereby initiating current flow through the optical isolator 402. This triggers the SCR Q2 and connects the power resistors R10, R11 across the terminals of the motor 92. The motor 92 now acts as a DC generator, causing a current to flow through R10 and R11. This heavy electrical load causes the motor to stop quickly. Power for the logic circuitry of FIG. 27 is provided by a small DC power supply 406. A transformer 408 provides 16 volts center-tapped to the diodes D1, D2. The diodes are connected in a full wave rectifier configuration to provide unregulated DC at approximately 11 volts to the voltage regulator 410. The voltage regulator 410 provides a 5-volt output for the logic circuitry associated with the microprocessor 399.

Figure 29:
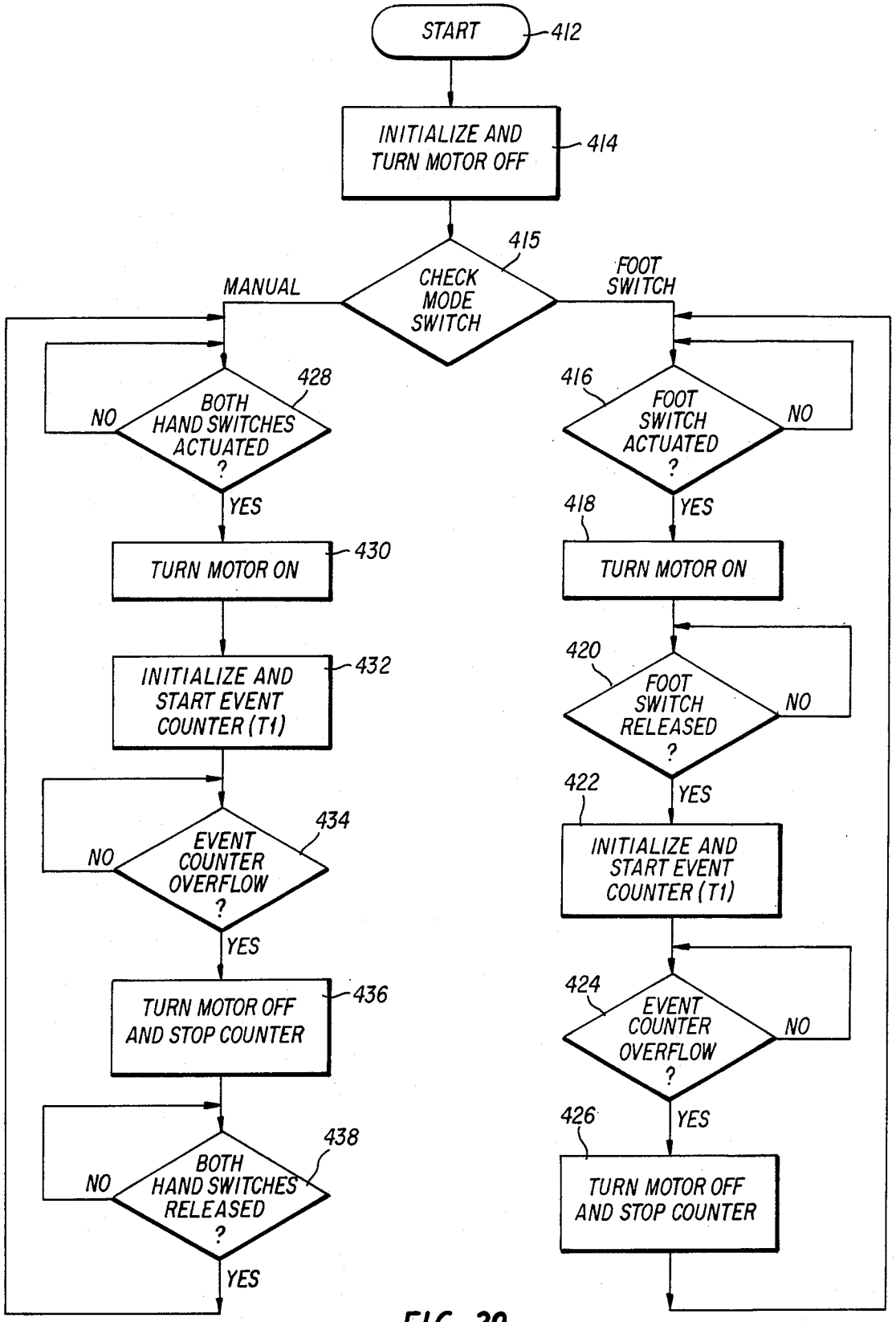
FIG. 29 is a flowchart illustrating the sequence of operations carried out by the microprocessor in the control board of FIG. 28.

FIG. 29 is a flow chart which illustrates the sequence of operations carried out by the microprocessors 399 of FIG. 27. The start block 412 is entered when the power to the printing machine 30 is turned on. In the next block 414, various internal registers of the microprocessor 399 are initialized and the motor 92 is stopped by bringing the output P10 low and the output P11 high as described previously. In block 415, the position of the mode switch 400 is checked, and, depending on the position found, the program will enter one of two different subroutines. If the mode switch is found to be in the FOOT SWITCH position, the microprocessor proceeds to block 416 and repeatedly checks to determine whether the foot switch has been actuated. As soon as the microprocessor detects actuation of the foot switch, the motor 92 is turned on as indicated in block 418. This involves bringing the output P10 of the microprocessor 399 high and the output P11 low as described previously. In block 420, the microprocessor checks to determine whether the FOOT switch has been released. If it has, the microprocessor proceeds to block 422, and initializes and starts an internal event counter which is incremented by the input T1. The T1 input of the microprocessor is connected to the home position switch 204, as illustrated in FIG. 27. The event counter is set to indicate an overflow condition when the count is equal to 1, which will occur as soon as the pad mechanism reaches the home position and triggers the home position switch 204. In block 424, the microprocessor repeatedly checks for an overflow condition of the event counter. When this condition is found, indicating that the printing machine has reached the home position, the microprocessor proceeds to block 426. In block 426, the motor 92 is stopped by bringing the microprocessor output P10 low and the output P11 high, as previously described, and the event counter is also stopped. The microprocessor then returns to block 416 and awaits a further actuation of the FOOT switch. If the FOOT switch is depressed continuously, rather than momentarily, the microprocessor repeatedly loops through block 420 after turning the motor on in block 418. As a result, the motor runs continuously while the foot switch remains depressed, and the printing machine 30 carries out successive printing operations without stopping at the home position. When the foot switch is released, the motor will continue to operate briefly until the printing machine reaches the home position, at which point the motor will stop. The foot switch mode can also be used when it is desired to trigger the operation of the printing machine automatically, as by means of a switch or sensor attached to a moving conveyor system carrying the articles to be printed.

Referring again to block 414, and assuming now that the mode switch is found to be in the MANUAL position, the microprocessor enters a different subroutine beginning at block 428. In block 428, the microprocessor repeatedly checks to determine whether both hand switches are actuated at the same time. The two hand switches will usually be placed at a distance from one another so that the operator must use both hands to operate them simultaneously. In this way, it is assured that the operator's hands are safely out of the way of the moving mechanisms of the printing machine. If the microprocessor detects the simultaneous actuation of both hand switches in block 428, it proceeds to block 430 and turns the motor on to begin the printing cycle. In block 432, the event counter is initialized and started as described previously. In block 434, the microprocessor repeatedly checks for an overflow condition of the event counter, which would indicate that the printing machine has reached the home position. When the overflow condition occurs, the microprocessor proceeds to block 436, where the motor is turned off and the event counter is stopped. The microprocessor then proceeds to block 438 and repeatedly checks to determine whether both hand switches have been released. If they have, the microprocessor returns to block 428 and awaits a further actuation of the hand switches before initiating a new printing cycle. In the manual mode of operation, both hand switches must be found to have been released in block 438 before the microprocessor will initiate a new printing cycle in block 428. This insures that the operator cannot defeat the two-switch system by "tying down" one of the hand switches so that it is permanently actuated, and then operating the printing machine with one hand using the remaining hand switch. It should be noted that, unlike the mode of operation in which the foot switch is used, the printing machine will carry out only one printing cycle at a time in the manual mode. As a result, even if both hand switches are depressed continually, the printing machine will stop at the home position after one cycle of operation.

Although the present invention has been described with reference to a preferred embodiment, it should be understood that the invention is not limited to the details thereof. Various substitutions and modifications may be made in the disclosed embodiment without departing from the spirit and scope of the invention as defined in the appended claims.

What is claimed is:

1. A pad transfer printing machine comprising:

an engraved printing plate suspended at an elevated position above a surface to be printed and having its engraved surface facing downwardly;

means for inking the printing plate and for removing excess ink therefrom;

a deformable transfer pad for transferring inked images from the printing plate to the surface to be printed; and a drive mechanism for moving the transfer pad in a cycle of movement comprising an upward stroke to bring the transfer pad into contact with the printing plate, a downward stroke to bring the transfer pad into contact with the surface to be printed, and a rotary movement following each upward and downward stroke to invert the transfer pad, said drive mechanism comprising:

a rod-like plunger carrying the transfer pad at one end thereof;

a pivoting member through which the plunger is axially reciprocable, said member being pivotable about a fixed horizontal axis which is perpendicular to the axis of the plunger;

a movable horizontal cross-member disposed parallel to and spaced from the axis of the pivoting member, said cross-member having its central portion affixed to the plunger;

a pair of aligned cam tracks for receiving the ends of the cross-member; and means including a rotary crank mechanism for causing the cross-member to move in the path defined by the cam tracks.

2. A pad transfer printing apparatus as claimed in claim 1, wherein the cross-member is affixed to the portion of the plunger between the transfer pad and the pivoting member.

3. A pad transfer printing machine comprising:

an engraved printing plate suspended at an elevated position above a surface to be printed and having its engraved surface facing downwardly, said printing plate being horizontally movable between a pad contacting position and a retracted position;

means for inking the printing plate and for removing excess ink therefrom during movement of the printing plate between the pad contacting and retracted positions;

a movable printing member carrying a deformable transfer pad, said printing member being arranged to move the transfer pad upwardly and downwardly between the printing plate and the surface to be printed and to invert the transfer pad after each upward and downward stroke, so that the transfer pad is alternately brought into contact with the printing plate at the top of its stroke and with the surface to be printed at the bottom of its stroke;

common drives means for synchronously moving the printing plate and the printing member in a manner such that the printing plate is temporarily held stationary at the pad contacting position when the transfer pad is at the top of its stroke;

said means for inking the printing plate and for removing excess ink therefrom comprising ink supply means suspended below the printing plate for applying ink to the engraved surface of the printing plate, and ink removal means for removing excess ink from the printing plate and for returning said excess ink by gravity to said ink supply means;

said printing plate being removable from the printing machine and said ink removal means being effective to remove excess ink from the printing plate during removal of the printing plate from the printing machine, and to return said excess ink by gravity to the ink supply means;

said ink supply means comprising an ink reservoir open at the top thereof and suspended at a fixed horizontal position below the printing plate and applicator means for applying ink from the reservoir to the engraved surface of the printing plate, said applicator means comprising a roller positioned for partial immersion in the ink contained in the ink reservoir and held in rolling contact with the engraved surface of the printing plate;

said ink removal means comprising a doctor blade carried by the ink reservoir;

said ink reservoir being mounted for vertical movement toward and away from the printing plate in order to bring the doctor blade alternately into and out of contact with the engraved surface of the printing plate; and said common drive means being effective to cause vertical movement of the ink reservoir in a manner such that the doctor blade is brought alternately into and out of contact with the engraved surface of the printing plate in synchronism with the movement of the printing plate between the pad contacting and retracted positions.

4. A pad transfer printing machine as claimed in claim 3, wherein the common drive means is effective to cause synchronized vertical movement of the ink reservoir in a manner such that the doctor blade is maintained out of contact with the printing plate during movement of the printing plate in one horizontal direction and is held in contact with the engraved surface of the printing plate during movement of the printing plate in the opposite horizontal direction.

5. A pad transfer printing machine as claimed in claim 4, wherein the doctor blade is maintained out of contact with the printing plate during movement of the printing plate in the direction from the pad contacting position to the retracted position, and is held in contact with the printing plate during movement of the printing plate in the direction from the retracted position to the pad contacting position.

6. A pad transfer printing machine comprising:

an engraved printing plate suspended at an elevated position above a surface to be printed and having its engraved surface facing downwardly, said printing plate being horizontally movable between a pad contacting position and a retracted position;

means for inking the printing plate and for removing excess ink therefrom during movement of the printing plate between the pad contacting the retracted positions;

a movable printing member carrying a deformable transfer pad, said printing member being arranged to move the transfer pad upwardly and downwardly between the printing plate and the surface to be printed and to invert the transfer pad after each upward and downward stroke, so that the transfer pad is alternately brought into contact with the printing plate at the top of its stroke and with the surface to be printed at the bottom of its stroke;

common drive means for synchronously moving the printing plate and the printing member in a manner such that the printing plate is temporarily held stationary at the pad contacting position when the transfer pad is at the top of its stroke, and said printing plate is moved between the pad contacting position and the retracted position as the transfer pad moves between the printing plate and the surface to be printed;

said means for inking the printing plate and for removing excess ink therefrom comprising ink supply means suspended below the printing plate for applying ink to the engraved surface of the printing plate and ink removal means for removing excess ink from the printing plate and for returning said excess ink by gravity to said ink supply means;

said printing plate being removable from the printing machine; and said ink removal means being effective to remove excess link from the printing plate during removal of the printing plate from the printing machine, and to return said excess ink by gravity to the ink supply means.

7. A pad transfer printing machine as claimed in claim 6, wherein said ink supply means comprises:

an ink reservoir open at the top thereof and suspended at a fixed horizontal position below the printing plate; and applicator means for applying ink from the reservoir to the engraved surface of the printing plate.

8. A pad transfer printing machine as claimed in claim 7, wherein said applicator means comprises a roller positioned for partial immersion in the ink contained in the ink reservoir and held in rolling contact with the engraved surface of the printing plate.

9. A pad transfer printing machine as claimed in claim 7, wherein said ink removal means comprises a doctor blade.

10. A pad transfer printing machine as claimed in claim 9, wherein said doctor blade is carried by the ink reservoir.

* * * * *